US010051975B2

(12) United States Patent
Taylor et al.

(10) Patent No.: US 10,051,975 B2
(45) Date of Patent: Aug. 21, 2018

(54) CHILD SEAT CONVERTIBLE TO MULTIPLE CONFIGURATIONS OF USE

(71) Applicant: Wonderland Nurserygoods Company Limited, Tuen Mun, N.T. (HK)

(72) Inventors: Andrew J. Taylor, Mohnton, PA (US); Anthony V. Ruggiero, Downingtown, PA (US); Curtis M. Hartenstine, Birdsboro, PA (US); Robert E. Haut, Merion Station, PA (US); Kyle S. Mason, West Lawn, PA (US)

(73) Assignee: Wonderland Switzerland AG, Triesen (CH)

( * ) Notice: Subject to any disclaimer, the term of this patent is extended or adjusted under 35 U.S.C. 154(b) by 63 days.

(21) Appl. No.: 15/382,766

(22) Filed: Dec. 19, 2016

(65) Prior Publication Data

US 2017/0112294 A1 Apr. 27, 2017

Related U.S. Application Data

(62) Division of application No. 14/304,213, filed on Jun. 13, 2014, now Pat. No. 9,554,657.

(Continued)

(51) Int. Cl.

*A47D 1/00* (2006.01)
*A47D 1/04* (2006.01)

(Continued)

(52) U.S. Cl.

CPC ..... *A47D 1/006* (2013.01); *A47C 7/54* (2013.01); *A47C 7/62* (2013.01); *A47D 1/004* (2013.01);

(Continued)

(58) Field of Classification Search

None

See application file for complete search history.

(56) References Cited

U.S. PATENT DOCUMENTS 3,550,998 A 12/1970 Boudreau et al.
3,992,056 A 11/1976 Koziatek et al.

(Continued)

FOREIGN PATENT DOCUMENTS

CN 102599768 A 7/2012
CN 102973049 A 3/2013

(Continued)

OTHER PUBLICATIONS

Office Action in co-pending CN Application No. 201410264091.X dated Mar. 28, 2016.

(Continued)

*Primary Examiner* — David E Allred

(74) *Attorney, Agent, or Firm* — Daniel A. Tallitsch; Baker McKenzie LLP

(57) ABSTRACT

A child seat includes a seat body, and a first and a second support respectively assembled with the seat body via a first and a second connection. The seat body has a seating surface and a bottom surface below the seating surface, and the first and second support are extendable below the bottom surface. The child seat has a first configuration in which the first support is configured as a leg resting board and the second support extends forward toward the first support, and a second configuration in which the first support is folded to a substantially horizontal position and the second support extends rearward so that the child seat is able to stand on the first and second supports.

20 Claims, 21 Drawing Sheets

Related U.S. Application Data

(60) Provisional application No. 61/956,705, filed on Jun. 14, 2013, provisional application No. 61/957,824, filed on Jul. 12, 2013, provisional application No. 61/959,655, filed on Aug. 29, 2013, provisional application No. 61/964,374, filed on Jan. 3, 2014.

(51) Int. Cl.

| | |
|---|---|
| ***A47D 1/06*** | (2006.01) |
| ***A47D 1/10*** | (2006.01) |
| ***A47C 7/54*** | (2006.01) |
| ***A47C 7/62*** | (2006.01) |
| ***A47D 1/02*** | (2006.01) |
| ***A47D 15/00*** | (2006.01) |

(52) U.S. Cl.
CPC ..... *A47D 1/02* (2013.01); *A47D 1/04* (2013.01); *A47D 1/06* (2013.01); *A47D 1/103* (2013.01); *A47D 15/00* (2013.01)

(56) References Cited

U.S. PATENT DOCUMENTS

| | | | | | |
|---|---|---|---|---|---|
| 4,768,795 | A | | 9/1988 | Mar | |
| 4,786,064 | A | * | 11/1988 | Baghdasarian | B62B 7/12 280/30 |
| 4,902,026 | A | * | 2/1990 | Maldonado | B60N 2/2848 280/30 |
| 5,360,221 | A | * | 11/1994 | Chai | B60N 2/2839 280/30 |
| 5,562,548 | A | * | 10/1996 | Pinch | A47D 13/105 297/256.12 |
| 5,951,102 | A | | 9/1999 | Poulson et al. | |
| 6,033,019 | A | | 3/2000 | Hession-Kunz et al. | |
| 6,089,653 | A | | 7/2000 | Hotaling et al. | |
| 6,237,996 | B1 | | 5/2001 | Chen et al. | |
| 6,343,837 | B1 | | 2/2002 | Gage | |
| 7,568,758 | B2 | | 8/2009 | Troutman et al. | |
| 8,308,229 | B2 | * | 11/2012 | Galley | A47D 1/10 297/118 |
| 8,657,326 | B2 | * | 2/2014 | Shaanan | B62B 7/142 280/47.38 |
| 9,399,477 | B2 | * | 7/2016 | Iftinca | B62B 7/06 |
| 2003/0011221 | A1 | * | 1/2003 | Yoshie | A47D 1/002 297/130 |
| 2004/0084938 | A1 | | 5/2004 | Tomas et al. | |
| 2008/0290699 | A1 | | 11/2008 | Golias | |
| 2009/0001776 | A1 | * | 1/2009 | Bearup | A47D 1/002 297/153 |
| 2009/0295198 | A1 | * | 12/2009 | Tomasi | A47D 1/002 297/16.1 |
| 2009/0315375 | A1 | * | 12/2009 | Hu | A47D 15/006 297/256.16 |
| 2012/0286545 | A1 | | 11/2012 | Cheng | |

FOREIGN PATENT DOCUMENTS

| | | | |
|---|---|---|---|
| DE | 2981659 | U | 12/1998 |
| DE | 20100094 | U1 | 4/2001 |
| EP | 1714589 | A1 | 10/2006 |
| WO | 2011162618 | A1 | 12/2011 |

OTHER PUBLICATIONS

Office Action in co-pending DE Application No. 102014108359 dated Jun. 1, 2015.

* cited by examiner

CHILD SEAT CONVERTIBLE TO MULTIPLE CONFIGURATIONS OF USE

CROSS-REFERENCE TO RELATED APPLICATIONS

This application is a Division of U.S. patent application Ser. No. 14/304,213 filed on Jun. 13, 2014, which respectively claims priority to U.S. Provisional Application No. 61/956,705 filed on Jun. 14, 2013; and to U.S. Provisional Application No. 61/957,824 filed on Jul. 12, 2013; and to U.S. Provisional Application No. 61/959,655 filed on Aug. 29, 2013; and to U.S. Provisional Application No. 61/964,374 filed on Jan. 3, 2014.

BACKGROUND

1. Field of the Invention

The present invention relates to a child seat convertible to multiple configurations of use.

2. Description of the Related Art

High chairs provide convenient and safe place for babies and children to eat food and occupy their time. Most high chairs are intended for children starting about 6 months old, when they are able to sit up unassisted and eat solid food. Certain high chairs currently available on the market can fold for easier storage and transport in a vehicle, the seat portion of the high chair remaining with the high chair frame when it is in the folded state. Other modular designs allow to lift the seat portion off the high chair frame and used as a booster seat. However, the modular designs usually require the leg rest of the seat portion to be left on the high chair frame. This causes the frame to look unsightly and prevents other uses of the frame. In addition, the booster seat may look too bulky to properly fit on a chair.

Therefore, there is a need for child seats that are more flexible and convenient in use, and can address at least the foregoing issues.

SUMMARY

The present application describes a child seat that is convertible to multiple configurations of use. In particular, the child seat can have a configuration in which it can be installed on a support frame at an elevated position above a ground surface, and another configuration in which it can stand independently as a booster seat. In some embodiments, the child seat includes a seat body, and a first and a second support respectively assembled with the seat body about a first and a second pivot axis spaced apart from each other and extending transversally relative to the seat body. The seat body has a seating surface, a bottom surface below the seating surface, and a front portion for placement of a child's legs, and the first and second support are extendable below the bottom surface. The child seat has a first configuration in which the first support is configured as a leg resting board and the second support extends forward toward the first support, and a second configuration in which the first support is folded to a substantially horizontal position and the second support extends rearward so that the child seat is able to stand on the first and second supports.

According to another embodiment, the child seat includes a seat body, and a first and a second support respectively assembled with the seat body via a first and a second pivotal connection. The seat body has a seating surface, a bottom surface below the seating surface, and a front portion for placement of a child's legs, and the first and second support are extendable below the bottom surface. The first and second supports are respectively rotatable relative to the seat body to convert the child seat between a first and a second configuration, the first and second supports respectively extending forward from the first and second pivotal connections in the first configuration, and the first support being folded to a substantially horizontal position and the second support extending rearward so that the child seat is able to stand on the first and second supports in the second configuration.

DETAILED DESCRIPTION OF THE EMBODIMENTS

Figure 3:
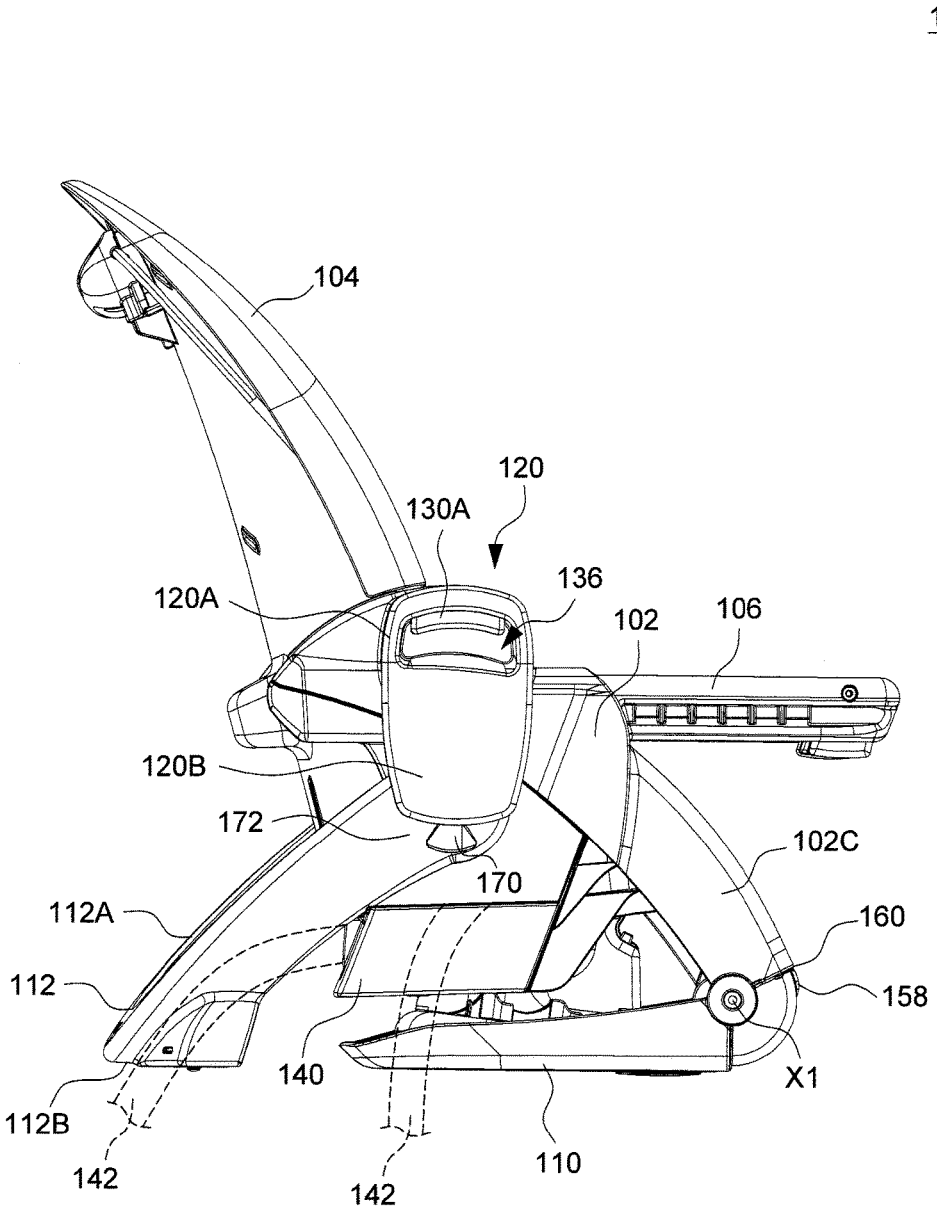
FIG. 3 is a side view of the child seat shown in FIG. 1 in the booster seat configuration.
Figure 4A:
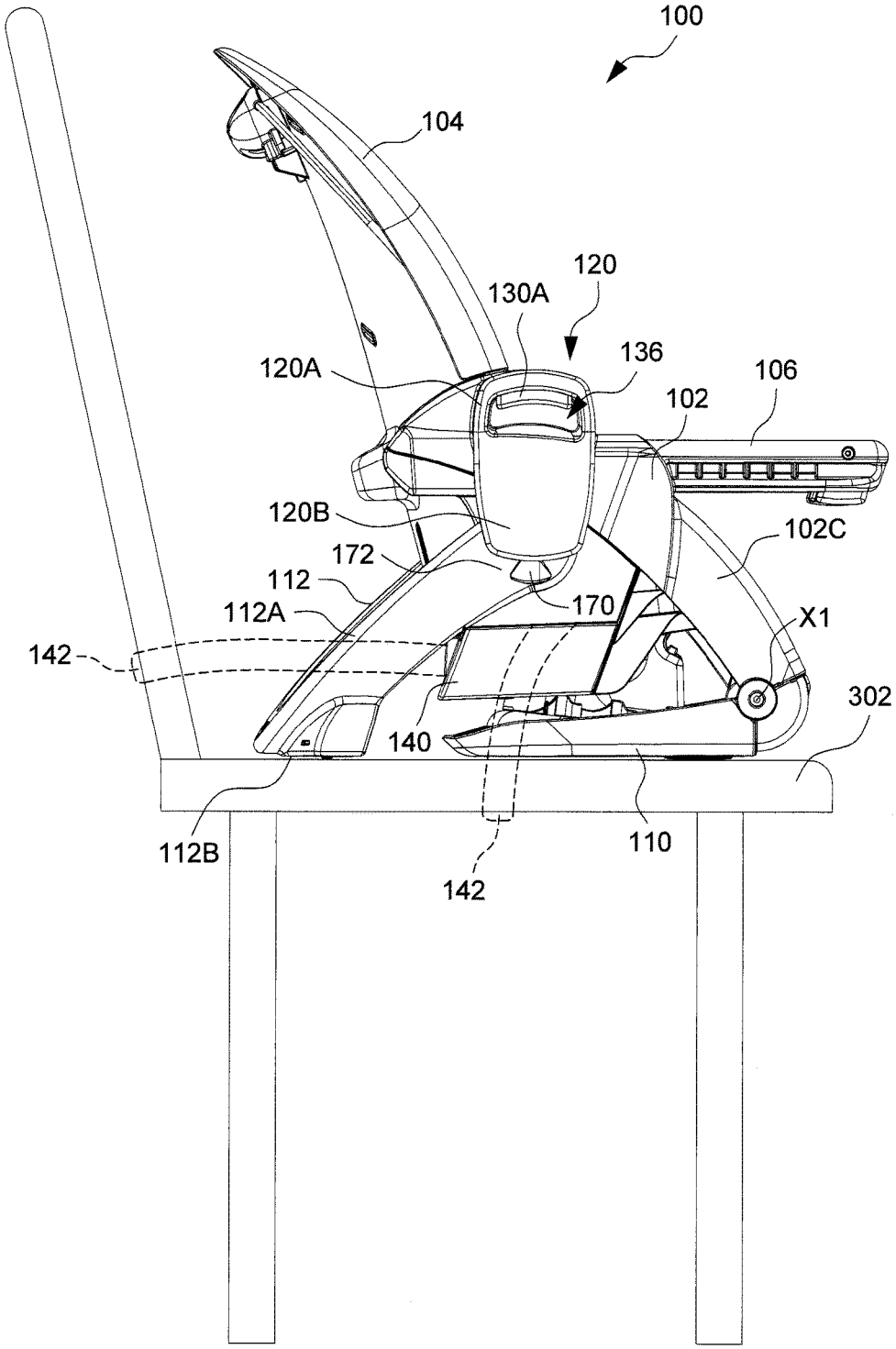
FIG. 4A is a schematic view illustrating the child seat of FIG. 1 installed on a chair.
Figure 4B:
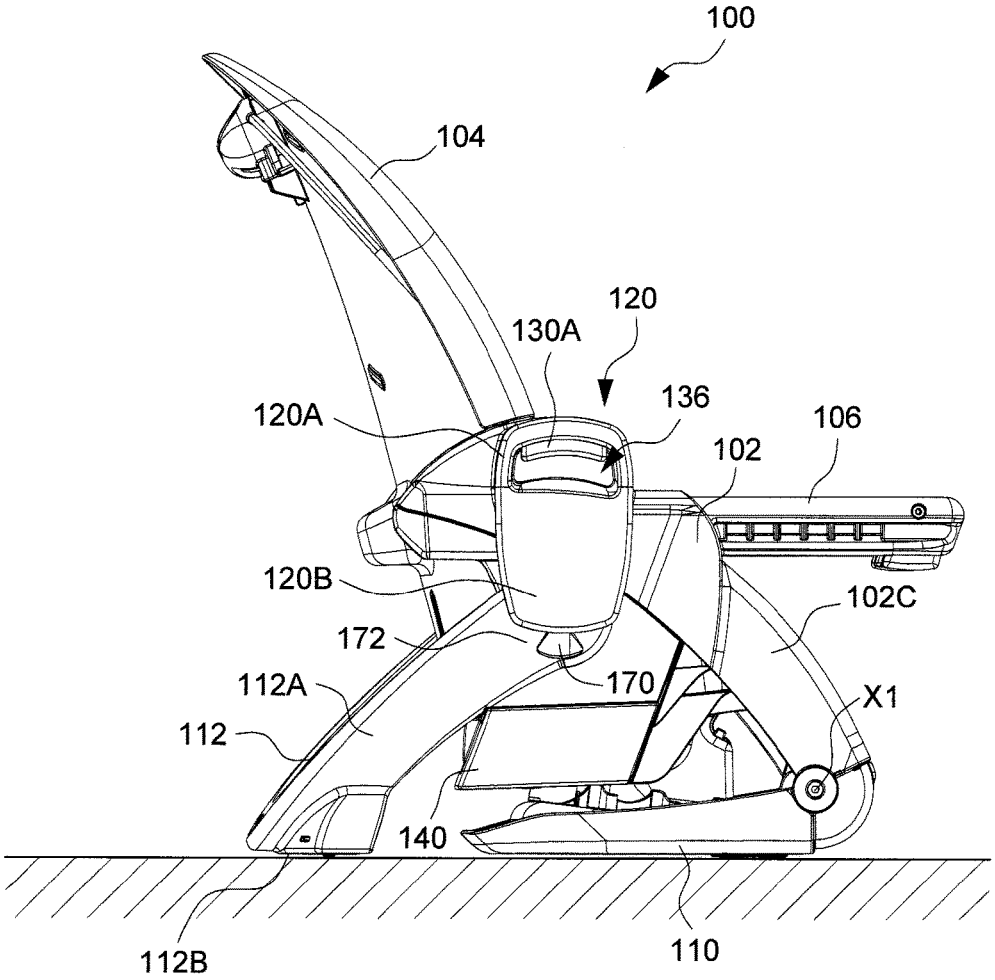
FIG. 4B is a schematic view illustrating the child seat of FIG. 1 standing on a floor surface.
Figure 5:
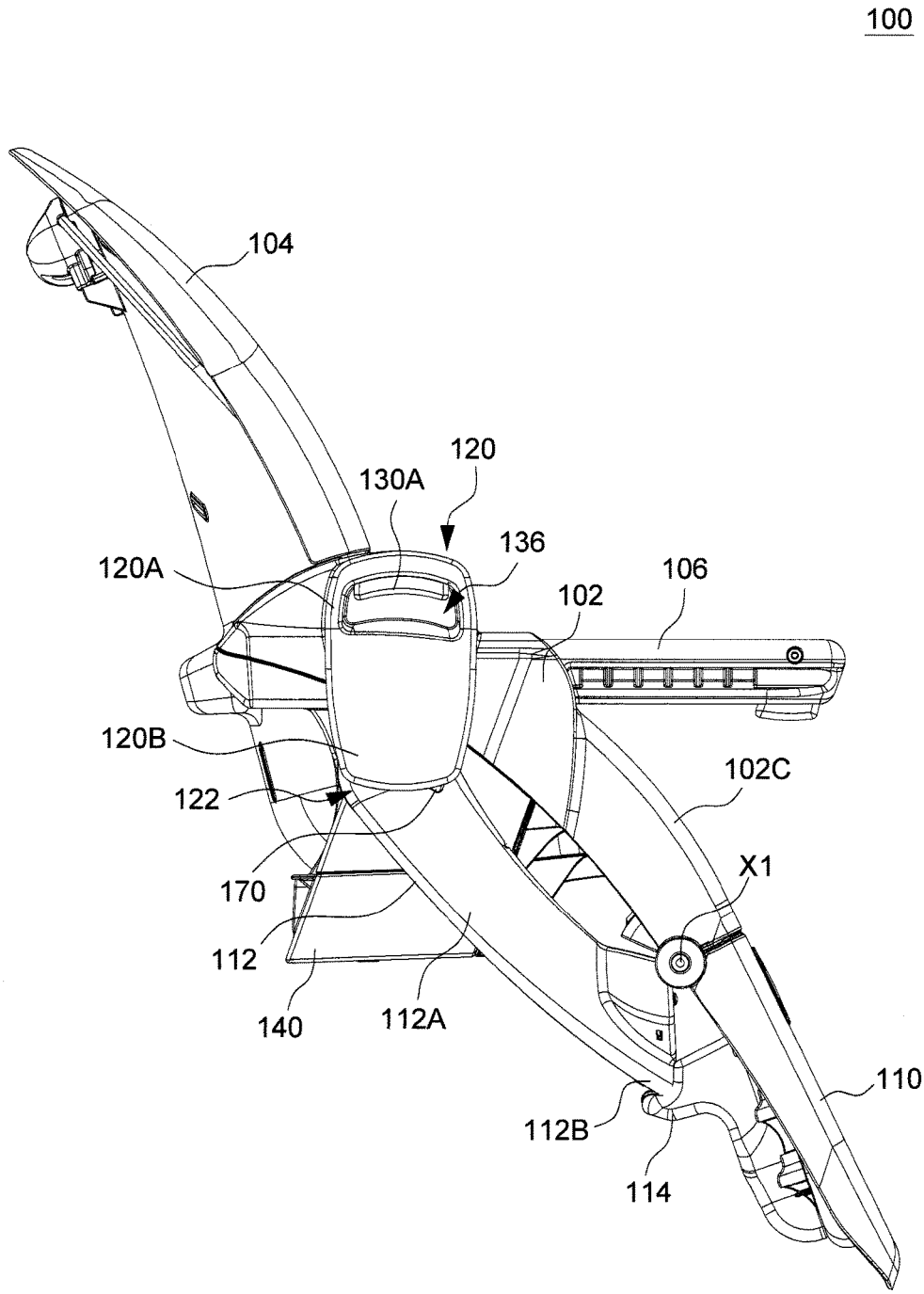
FIG. 5 is a side view illustrating the child seat of FIG. 1 in a mount configuration suitable for installation on a support frame.
Figure 6:
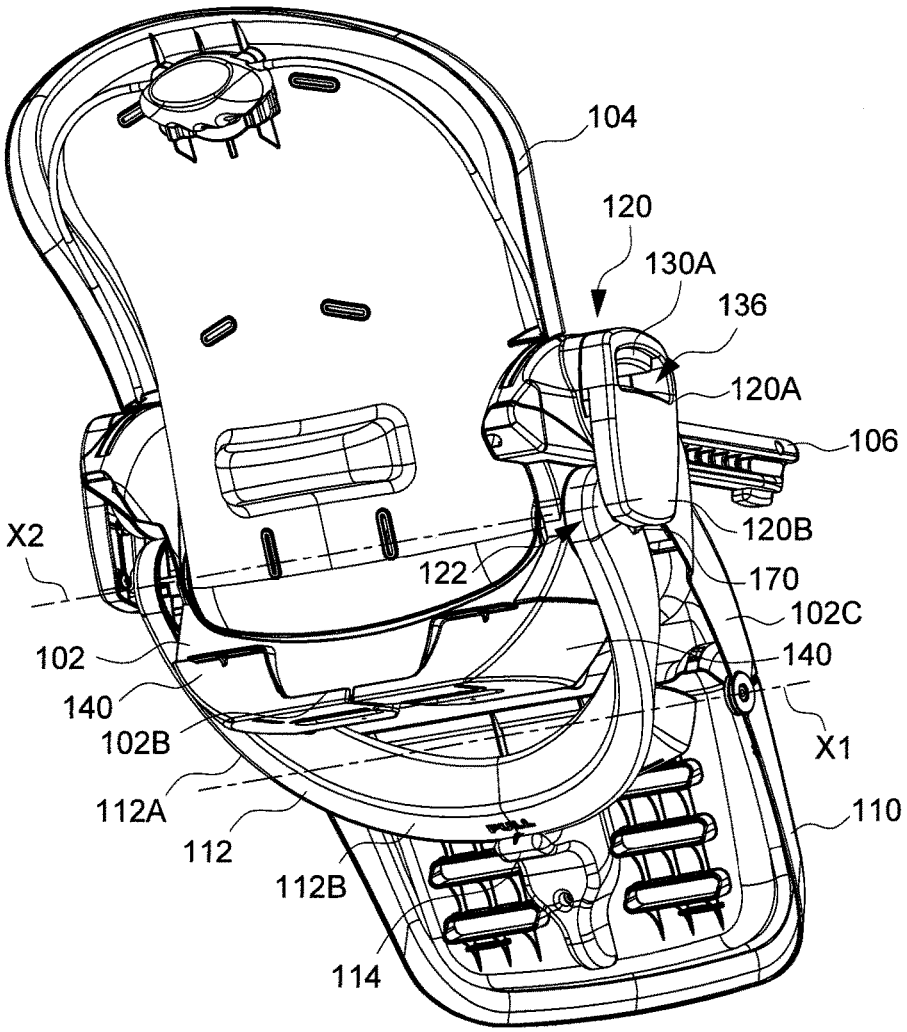
FIG. 6 is a perspective view of the child seat in the mount configuration.
Figure 7:
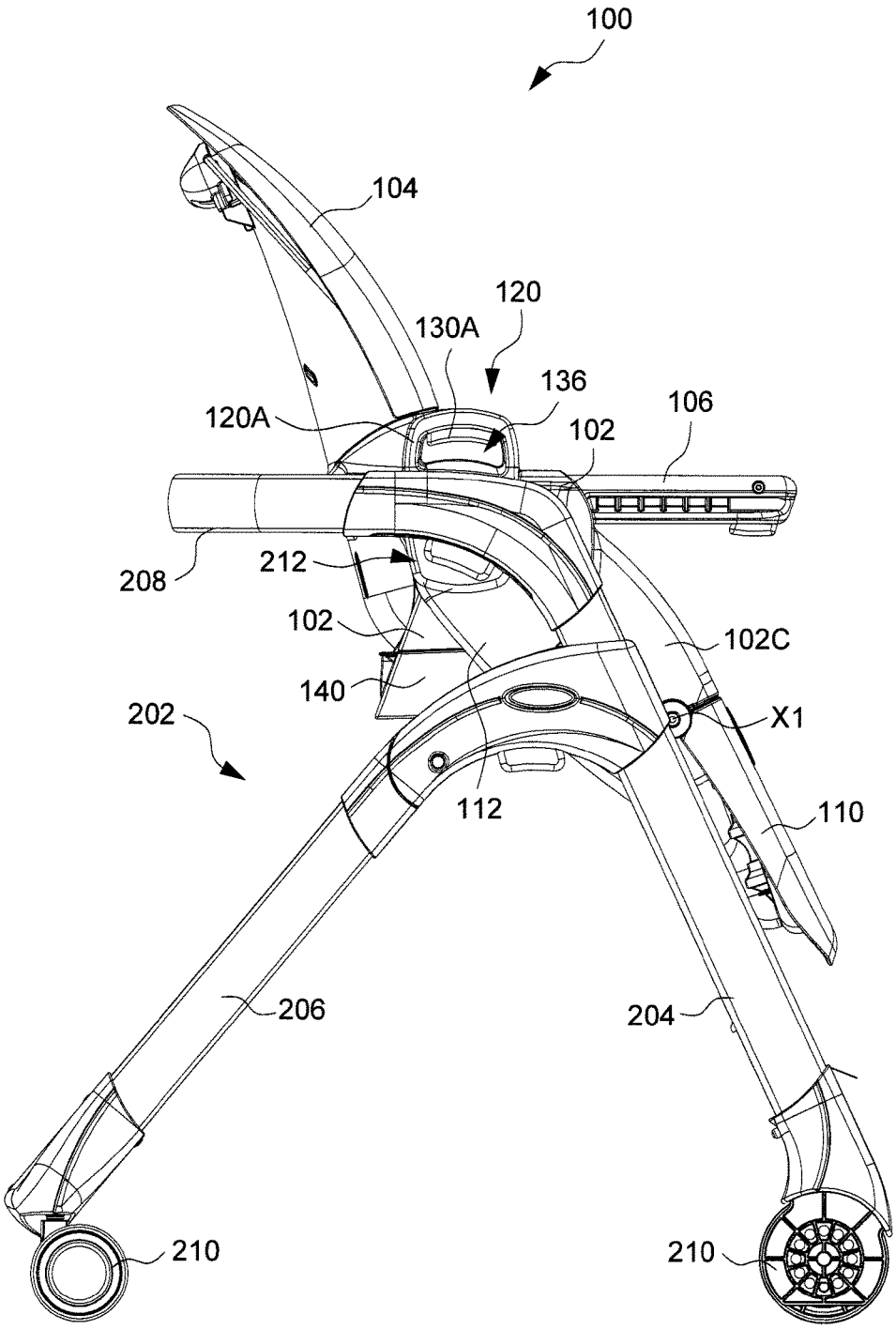
FIG. 7 is a schematic view illustrating the child seat in the mount configuration installed on a support frame to form a high chair.
Figure 8:
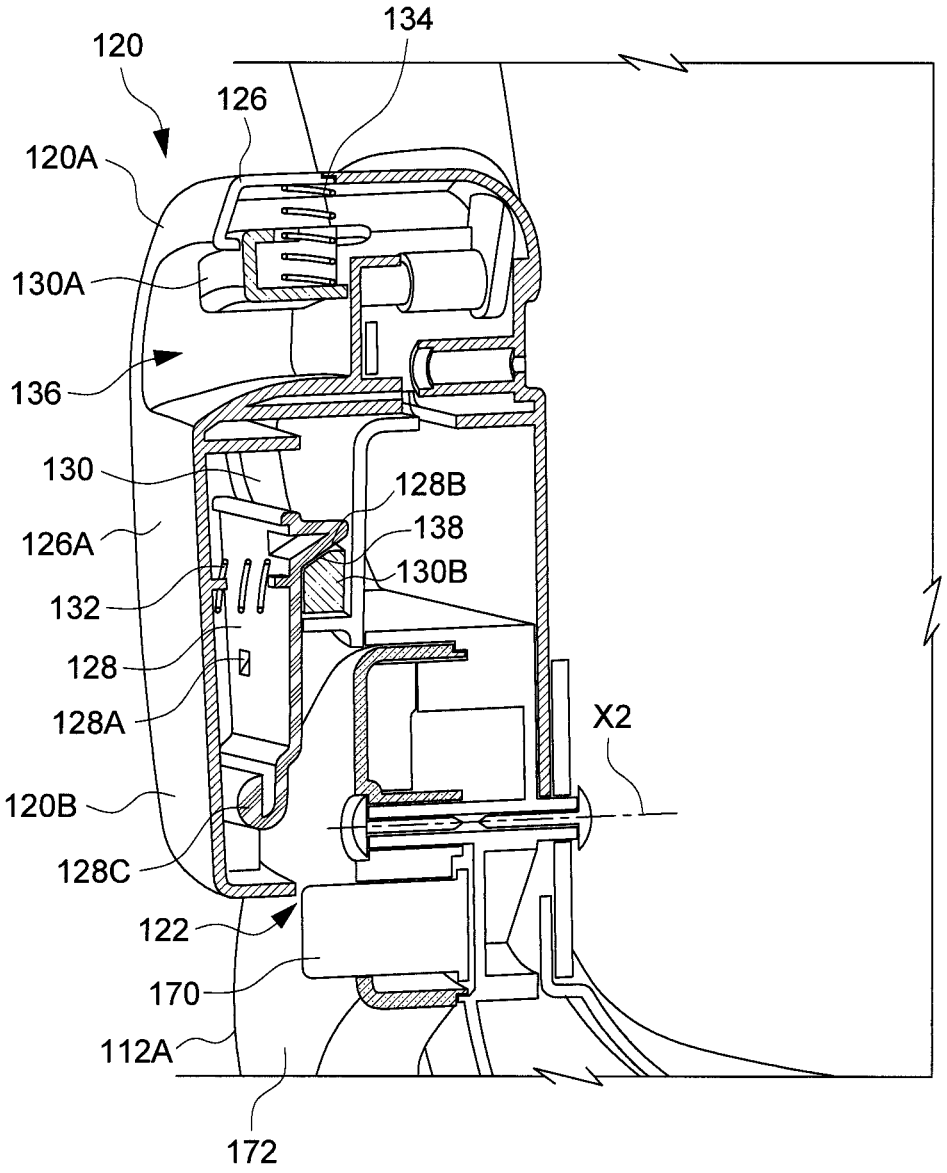
FIG. 8 is a cross-sectional view illustrating the construction of a connector provided in the child seat.
Figure 9:
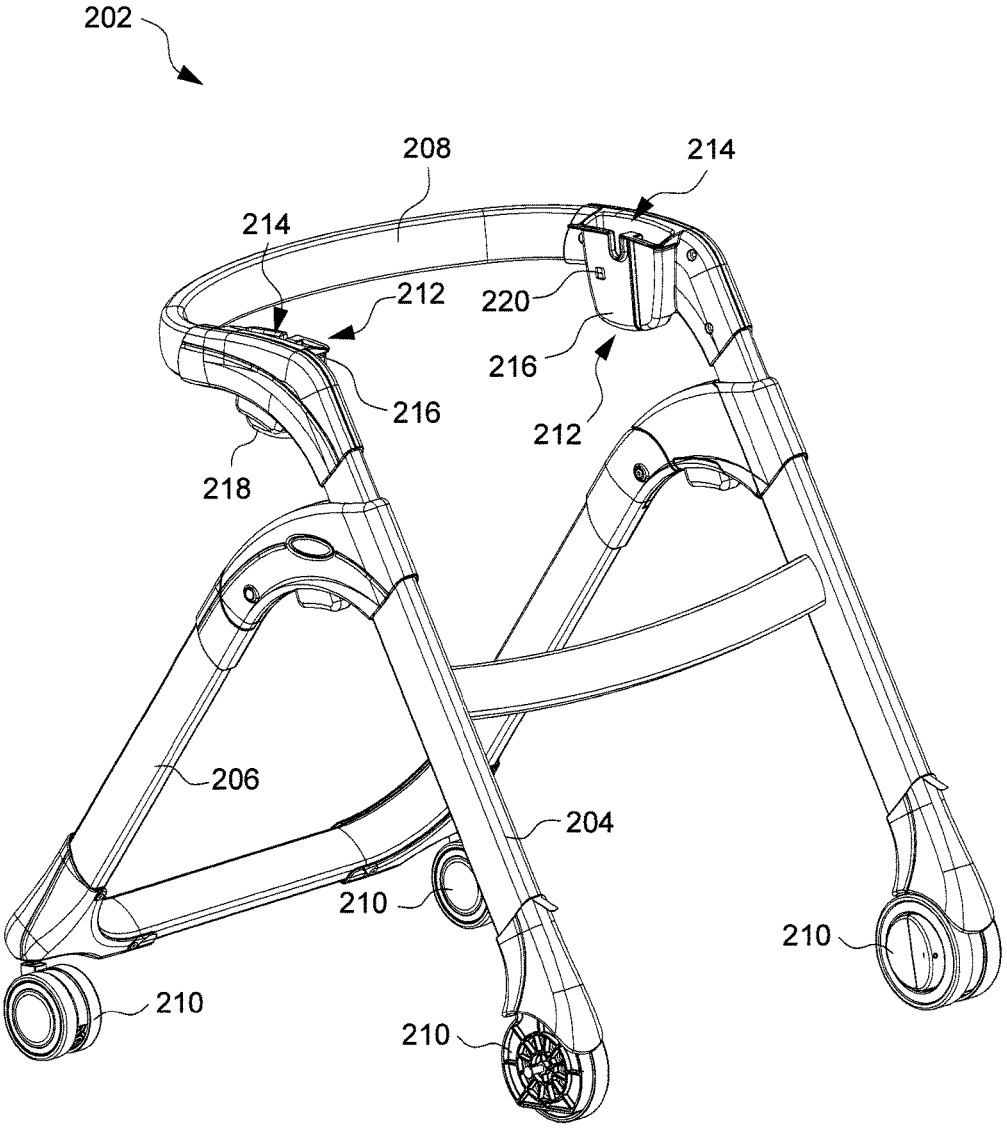
FIG. 9 is a schematic view illustrating the support frame of the high chair alone.

FIGS. 1-7 are schematic views illustrating an embodiment of a child seat 100 that is convertible to multiple configurations. To facilitate the use of the child seat 100 in different configurations, the child seat 100 can have a structure comprised of adjustable front and rear supports 110 and 112. In FIGS. 5-7, the child seat 100 is shown in a mount configuration adapted for installation on a support frame 202 as shown in FIG. 7, which can be exemplary a high chair support frame. In this mount configuration, the child seat 100 can be installed on the support frame 202 at an elevated position above a ground surface, and the assembly of the child seat 100 with the support frame 202 can form a child high chair. In FIGS. 1-3, 4A and 4B, the child seat 100 is shown in another configuration in which it can be converted to a booster seat that can stand independent of the support frame 202. In this booster seat configuration, the child seat 100 can be placed on a support surface, e.g., a regular adult chair 302 as shown in FIG. 4A or a floor as shown in FIG. 4B.

Referring to FIGS. 1-3, 5 and 6, the child seat 100 can include a seat body 102, a seatback 104, and left and right armrests 106. The seat body 102 can be exemplary formed by a shell body made by plastic molding. In one embodiment, the seatback 104 may be detachably assembled with the seat body 102, and can be adjustable to different recline positions. In other embodiments, the seat body 102 and the seatback 104 may be formed in a single body. The seat body 102 has a seating surface 102A, a bottom surface 102B below the seating surface 102A and a front portion 102C. A child sitting on the seating surface 102A can have the back lying adjacent to the seatback 104, and the legs placed adjacent to the front portion 102C. To provide comfortable resting of the child's legs, the front portion 102C of the seat body 102 can progressively slope downward toward the front. Moreover, the armrests 106 may be operable to retract and extend outward with respect to the seat body 102. When the child seat 100 is used in combination with the support frame 202 as a high chair (as shown in FIG. 7) or without the support frame 202 (as shown in FIG. 4A), retraction of the armrests 106 may facilitate placement of the child seat 100 closer to a table.

The child seat 100 further includes a front support 110 and a rear support 112 that are respectively assembled with the seat body 102 via a first and a second connection spaced apart from each other. The front and rear supports 110 and 112 are extendable below the bottom surface 102B, and can be adjustable to convert the child seat 100 between the two configurations shown in FIGS. 1-4B and 5-7. Moreover, when the child seat 100 is converted to the booster seat configuration shown in FIGS. 1-4B, the positions of the front and rear supports 110 and 112 are such that the child seat 100 can stand on the front and rear supports 110 and 112 in a stable manner.

In one embodiment, the front support 110 can be formed as a unitary board having a width substantially equal to the width of the seat body 102. The front support 110 can have an end portion pivotally connected with the seat body 102 about a pivot axis X1 that extends transversally along a width direction of the child seat 100. The pivotal axis X1 is located below the seating surface 102A of the seat body 102 and adjacent to the front portion 102C, e.g., adjacent to a front end of the seat body 102. The front support 110 can rotate about the pivot axis X1 relative to the seat body 102 between two positions: a first position in which the front support 110 extends forward and downward from the pivotal connection of the pivot axis X1 (as shown in FIGS. 5-7), and a second position in which the front support 110 is folded toward the bottom surface 102B and extends rearward from the pivotal connection of the pivot axis X1 (as shown in FIGS. 1-4B). When the front support 110 is in the first position shown in FIGS. 5-7, the front support 110 can be configured as a leg resting board. When the front support 110 is in the second position as shown in FIGS. 1-4B, the front support 110 extends substantially horizontally below the bottom surface 102B to provide standing support for the child seat 100.

Referring again to FIGS. 1-3, 5 and 6, the rear support 112 can be formed as a unitary part of a generally U-shape including a left and a right side segment 112A, and a foot portion 112B connected with the two side segments 112A. The rear support 112 is arranged so that it can straddle the bottom surface 102B from the underside, and the two side segments 112A can have end portions pivotally connected with the seat body 102 about a pivot axis X2 that extends transversally along a width direction of the child seat 100. The pivotal connection defining the pivotal axis X2 of the rear support 112 can be located above and rearward from the pivotal connection defining the pivot axis X1 of the front support 110. As a result, the pivot axis X2 of the rear support 112 is located above and rearward from the pivot axis X1 of the front support 110. In one embodiment, the pivot axis X2 may further be arranged above the seating surface 102A of the seat body 102. A higher connection of the rear support 112 may provide more stable support. The rear support 112 can rotate about the pivot axis X2 relative to the seat body 102 between two positions: a first position in which the rear support 112 extends forward and downward from the pivotal connection defining the pivot axis X2 (as exemplary shown in FIGS. 5-7), and a second position in which the rear support 112 extends rearward and downward from the pivotal connection defining the pivot axis X2 (as exemplary shown in FIGS. 1-4B).

When the rear support 112 is adjusted forward as shown in FIGS. 5 and 6, the foot portion 112B is in a forward position adjacent to the front support 110 and the front portion 102C of the seat body 102, and the front support 110 can extend downward below the foot portion 112B. In this mount configuration, the front support 110 and the rear support 112 cannot provide stable standing support for the child seat 100.

Figure 1:
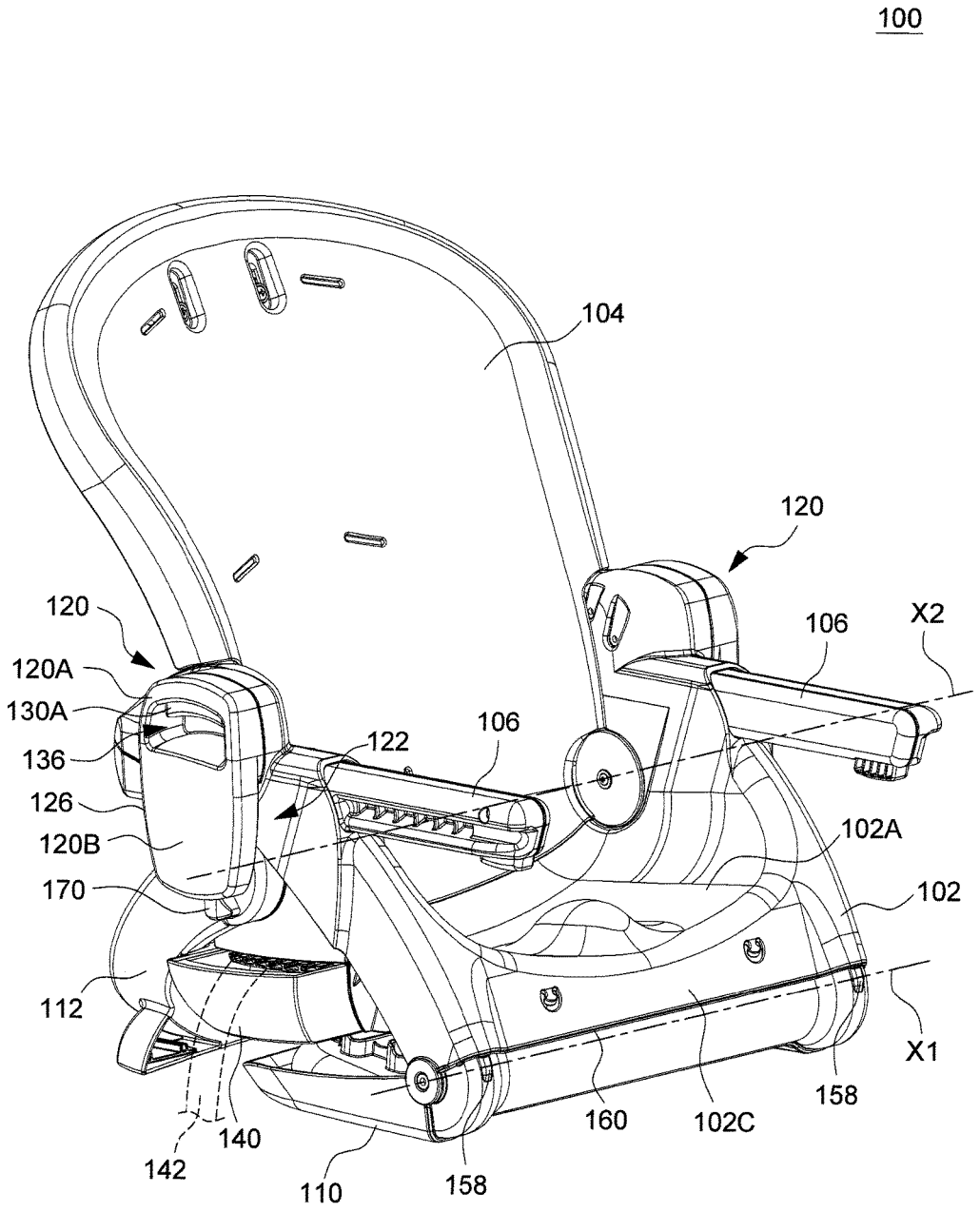
FIG. 1 is a perspective view illustrating an embodiment of a child seat in a booster seat configuration.
Figure 2:
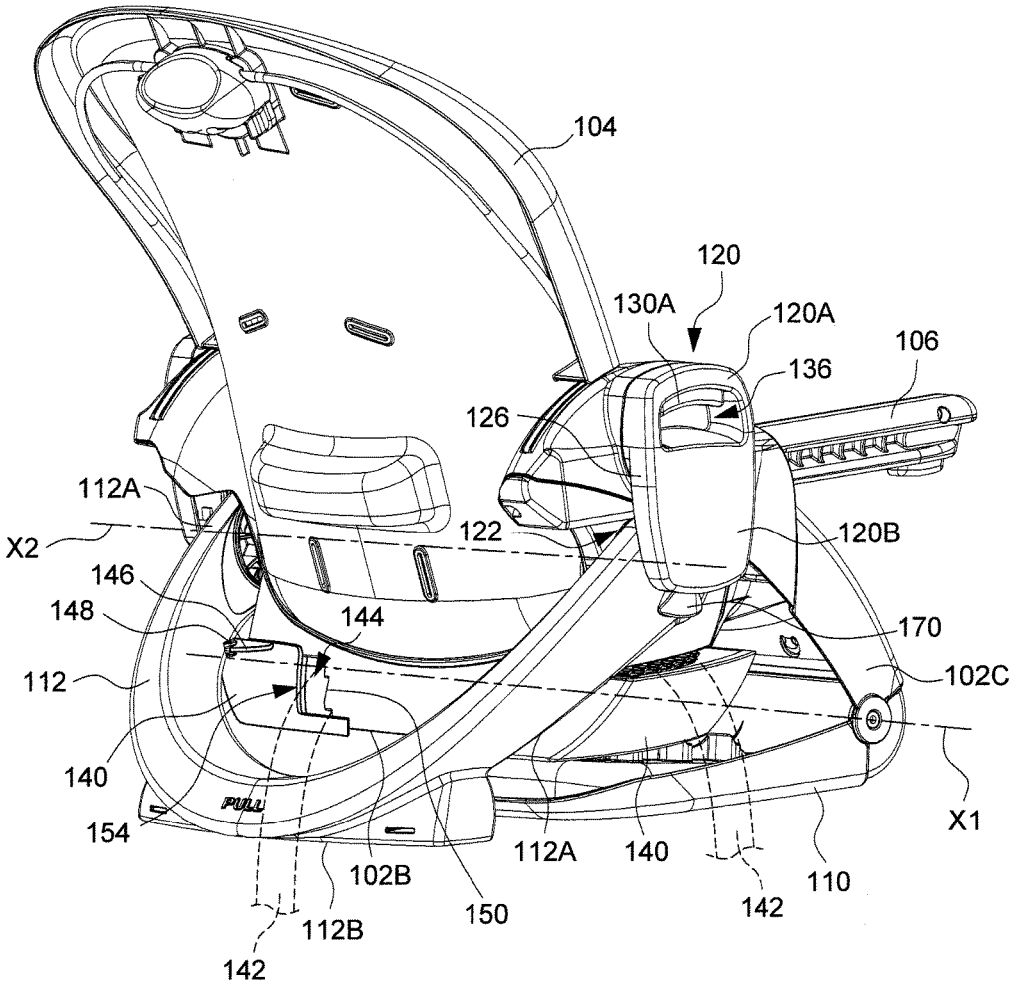
FIG. 2 is another perspective view of the child seat shown in FIG. 1 in the booster seat configuration.

When the rear support 112 is adjusted rearward as shown in FIGS. 1-3, the foot portion 112B of the rear support 112 is in a rearward position and can rest in contact against a support surface (i.e., an adult chair or a floor) for supporting the child seat 100.

In one embodiment, when the front and rear supports 110 and 112 are adjusted forward in the mount configuration shown in FIGS. 5 and 6, the front and rear supports 110 and 112 can further be locked with each other. For example, a rear surface of the front support 110 can have a catch 114 arranged offset from the pivot axis X1, and the rear support 112 when extending forward can engage with the catch 114 by interference fit. The front and rear supports 110 and 112 can be thereby kept adjacent to together. When the rear support 112 is rotated to extend rearward in the booster seat configuration shown in FIGS. 1-3, the rear support 112 can disengage and unlock from the catch 114 of the front support 110.

It is worth noting that while the catch 114 uses interference fit to interlock the front support 110 with the rear support 112, other mechanisms may also be applicable. For example, another embodiment not shown may provide a movable latch on one of the front and rear support 110 and 112 that can engage with a slot arranged on the other one of the front and rear support 110 and 112.

Referring to FIGS. 1-3, 5 and 6, for installing the child seat 100 with the support frame 202, each of a left and a right side of the seat body 102 can be respectively provided with a connector 120. The connector 120 can have an upper portion 120A and a lower portion 120B joined with each other. The upper portion 120A of the connector 120 can be connected with the seat body 102. The lower portion 120B of the connector 120 can project downward past the pivot axis X2 of the rear support 112, and lie at an outer side of the side segment 112A of the rear support 112. The lower portion 120B of the connector 120 is transversally spaced apart from the side segment 112A by a gap 122 that is opened downward. When the child seat 100 is converted to the mount configuration shown in FIGS. 5-7, the connector 120 can engage and lock with the support frame 202 so that the child seat 100 can be supported by the support frame 202 at an elevated position above a floor surface.

In conjunction with FIGS. 1-7, FIG. 8 is a cross-sectional view illustrating the construction of the connector 120. The connector 120 can include a housing 126 affixed with the seat body 102, a latch 128 assembled with the housing 126, a release handle 130 operatively connected with the latch 28, and springs 132 and 134. The latch 128 can be pivotally assembled through the interior of the housing 126 (e.g., an end portion 128C of the latch 128 can be pivotally connected with the housing 126), and can be formed to include an engaging portion 128A protruding inward (i.e., toward the seat body 102), and a ramped surface 128B. The latch 128 can pivot transversally relative to the housing 126 to effect locking or unlocking. For example, the latch 128 can rotate in a first direction toward the seat body 102 for locking, and in a second direction away from the seat body 102 for unlocking. The spring 132 can be respectively connected with the latch 128 and an inner sidewall of the housing 126, and can transversally bias the latch 128 to a locking position.

The outer surface 126A of the housing 126 can further include a recess 136 arranged in the upper portion 120A of the connector 120. The release handle 130 is assembled in the housing 126, and can have a curved shape that bends around the recess 136. The release handle 130 can be formed to include an actuating portion 130A that is accessible in the recess 136, and a driving portion 130B having a ramped surface 138 in sliding contact with the ramped surface 128B of the latch 128. The spring 134 can be respectively connected with the release handle 130 and an upper surface inside the housing 126.

When the release handle 130 is displaced vertically upward by pressing on the actuating portion 130A, owing to the interaction between the ramped surface 138 of the release handle 130 and the ramped surface 128B of the latch 128, the latch 128 can be urged by the release handle 130 to rotate for unlocking and compressing the spring 132. After a caregiver releases the release handle 130, the spring 134 can urge the release button 130 to move downward to recover its initial position, while the spring 132 can bias the latch 128 to the locking position.

Referring again to FIGS. 1-3, 5 and 6, the seat body 102 can further include two storage drawers 140 located below the seating surface 102A for receiving harness straps 142 (shown with phantom lines). More specifically, a left and a right side portion of the seat body 102 below the seating surface 102A can respectively have openings 144, and the storage drawers 140 can be respectively assembled through the openings 144 and near the bottom surface 102B of the seat body 102. The storage drawers 140 can be movable transversally in opposite directions between an opened and closed state.

When the child seat 100 is converted to the booster seat configuration shown in FIG. 1-4 and is placed on an adult chair 302, the storage drawers 140 can be opened, and the harness straps 142 can be pulled out to attach the child seat 100 with the adult chair 302. The storage drawers 140 when in the opened state can abut the side segments 112A of the rear support 112, and block forward rotation of the rear support 112 from the rearward position (as shown in FIGS. 1-3) to the forward position (as shown in FIGS. 5 and 6). Accordingly, the opened storage drawers 140 can be used to maintain the rearward rear support 112 in the rearward position.

In one embodiment, one or two of the storage drawers 140 may further have a rear surface provided with a rib 146. When the storage drawers 140 are opened, the rib 146 can engage with a slit 148 provided on the corresponding side segment 112A of the rear support 112 to help supporting the storage drawers 140 in the opened state.

When the storage drawers 140 are in the closed state, the rear support 112 can be freely rotated relative to the seat body 102 and travel either forward or rearward past the storage drawers 140 for adjustment to any of the forward and rearward positions. Moreover, while the rear support 112 is in the forward position, the side segments 112A are located adjacent to the front of the storage drawers 140 and can block outward displacement of the storage drawers 140 to the opened state. Accordingly, the forward position of the rear support 112 can restrain the storage drawers 140 to remain in the closed state.

In one embodiment, each of the storage drawers 140 and the corresponding opening 144 may also be provided with an interlock structure that can prevent the storage drawers 140 from closing unless the harness straps 142 are fully stowed in the storage drawers 140. For example, as better shown in FIG. 2, the opening 144 may have a rim 150, the storage drawer 140 can have an edge in which is formed a slit 154, and the rim 150 engages through the slit 154 when the storage drawer 140 is fully closed. In case the harness straps 142 hang outside the storage drawers 140, the harness straps 142 would hinder the engagement of the rim 150 with the slit 154 and thereby prevent closing of the storage drawers 140.

As shown in FIGS. 5-7, the child seat 100 has one configuration in which it can be installed on a support frame 202 of a high chair. In conjunction with FIGS. 5-7, FIG. 9 is a schematic view illustrating the support frame 202 alone. The support frame 202 can include a front leg frame 204, a rear leg frame 206 connected with the front leg frame 204, and a mount frame 208 assembled with the front leg frame 204. The front leg frame 204 and the rear leg frame 206 can have lower ends provided with a plurality of wheels 210 to facilitate transport of the support frame 202. In one embodiment, the mount frame 208 can have a generally U-shape, and can be connected with an upper end of the front leg frame 204. The mount frame 208 can be affixed with two sockets 212 that are respectively arranged at the left and right sides of the mount frame 208 and can respectively receive the insertion of the connectors 120.

Each of the sockets 212 can have an opening 214 defined between an inner sidewall 216 and an outer sidewall 218, the inner sidewall 216 being closer to a central region of the mount frame 206 than the outer sidewall 218. The inner sidewall 216 can be provided with an inner slot 220 for engagement of the latch 128 of the connector 120.

Referring to FIGS. 5-9, for installing the child seat 100 on the support frame 202, the connectors 120 can be respectively inserted into the sockets 212 until the latches 128 of the connectors 120 respectively engage with the inner slots 220 in the sockets 212. While each connector 120 is inserted into the corresponding socket 212, the inner sidewall 216 of the socket 212 can be received in the gap 122 between the side segment 112A of the rear support 112 and the connector 120. Once the latches 128 urged by the springs 132 respectively engage with the inner slots 220, the child seat 100 is locked with the support frame 202. The support frame 202 can thereby hold the child seat 100 at an elevated position above a floor surface. In this configuration, a substantial length of the front support 110 and a substantial length of the rear support 112 respectively extend from the pivot axes X1 and X2 in a forward direction and downward past the bottom surface 102B of the seat body 102. Moreover, the foot portion 112B of the rear support 112 can be in locking engagement with the catch 114 of the front support 110, and the front support 110 can be locked in place and can be used as a leg resting board. The assembly of the child seat 100 with the support 202 can thereby form a child high chair.

For converting the child seat 100 from the mount configuration shown in FIGS. 5 and 6 to the booster seat configuration shown in FIGS. 1-3, the rear support 112 is first unlocked from the front support 110. The rear support 112 is then rotated about the pivot axis X2 toward the rear of the child seat 100 until it reaches its rearward position, and the front support 110 is rotated toward the bottom surface 102B of the seat body 102. In the booster seat configuration, the front support 110 extends substantially horizontally below the bottom surface 102B, and a substantial length of the rear support 112 extends rearward and downward from the pivot axis X2 past the bottom surface 102B of the seat body 102. Accordingly, the child seat 100 can stand independently and in a stable manner on the first and second supports 110 and 112. In the booster seat configuration, the child seat 100 can be placed on the adult chair 302 as shown in FIG. 4A, or on a floor as shown in FIG. 4B.

Figure 10:
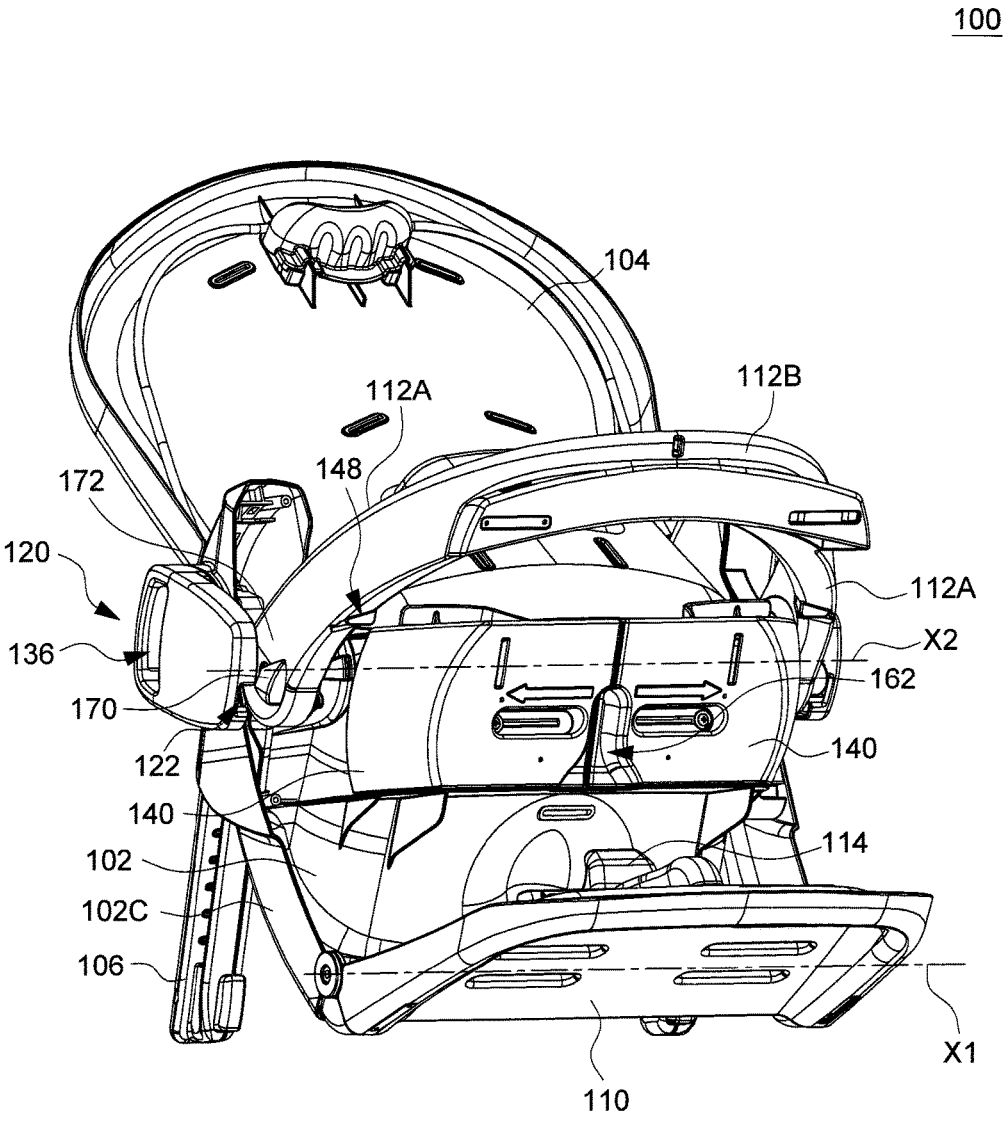
FIG. 10 is a schematic view illustrating another structure for locking the front support of the child seat in the booster seat configuration.

In some embodiment, a locking structure may be provided to lock the front support 110 in the horizontal position of the booster seat configuration. For example, referring to FIG. 1, the front support 110 can include one or more detent 158 that is located near the pivot axis X1. When the front support 110 is in the horizontal position, the detent 158 can be in interference against an edge 160 of the front portion 102C to hamper forward rotation of the front support 110 away from the bottom surface 102B. In another embodiment shown in FIG. 10, the bottom surfaces of the storage drawers 140 may be formed with a slot 162, and a protruding portion of the front support 110 (e.g., the catch 114) can engage with the slot 162 to hold the front support 110 in the horizontal position of the booster seat configuration.

Figure 11:
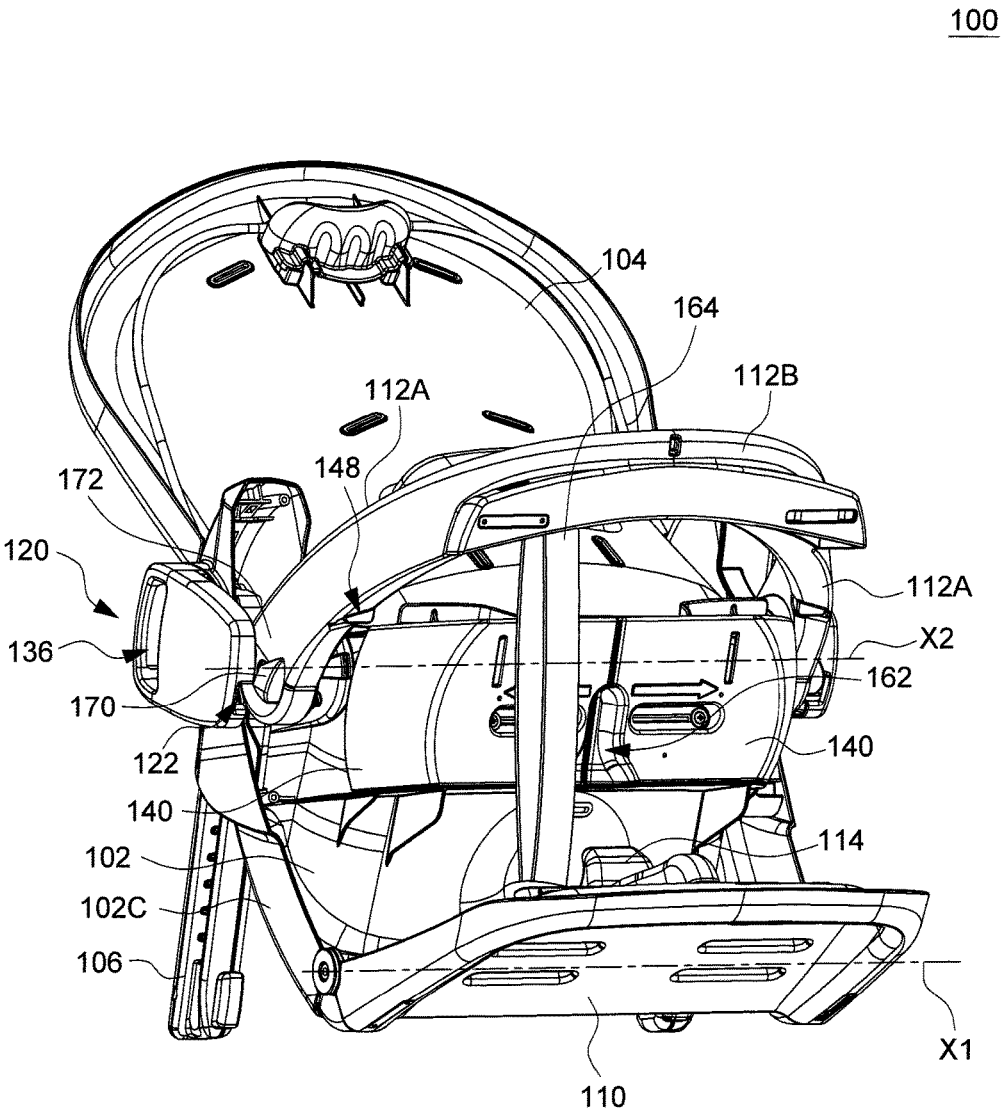
FIG. 11 is a schematic view illustrating a variant embodiment of the child seat provided with a linking part that respectively connects with the front and rear support of the child seat.

In some embodiment, a coupling structure may be provided to facilitate concurrent displacement of the front and rear support 110 and 112. For example, referring to FIG. 11, a linking part 164 may be respectively connected with the front support 110 and the rear support 112. The linking part 164 can exemplary be a strap made of a webbing material, and can have two ends respectively anchored with the front support 110 and the rear support 112 at locations offset from the pivot axes X1 and X2. When the rear support 112 is unlocked and moved rearward to the booster seat configuration, the rear support 112 can thereby pull the front support 110 to rotate rearward through the coupling of the linking part 164.

Referring to FIG. 4A, when the child seat 100 is converted to the booster seat configuration and is placed on an adult chair 302, the storage drawers 140 can be opened, and the harness straps 142 can be deployed and attached with the adult chair 302. The opened state of the storage drawers 140 can lock the rear support 112 in the booster seat configuration, which can improve safety of the child seat 100.

In some embodiments, it may be desirable to provide a safety mechanism that can prevent improper installation of the child seat 100 on the support frame 202 while the child seat 100 is in the booster seat configuration. Referring to FIGS. 1-3, 5 and 6, the safety mechanism can include one or more impeding portion 170. Each impeding portion 170 can be respectively connected with one corresponding side segment 112A of the rear support 112 near the pivot axis X2, and can project transversally outward from an outer surface 172 of the side segment 112A (i.e., in a direction away from a central region of the child seat 100) toward the gap 122. The impeding portion 170 can be in an obstructing position in the gap 122 to hinder insertion of the connector 120 into the socket 212 when the rear support 112 extends rearward in the booster seat configuration shown in FIGS. 1-3, and can move away from the gap 122 to allow insertion of the connector 120 into the socket 212 when the rear support 112 extends forward in the mount configuration shown in FIGS. 5 and 6.

In conjunction with FIGS. 1-3, 5, 6 and 8, FIGS. 12 and 13 are schematic views illustrating the assembly of the impeding portion 170 with the rear support 112. For clarity, a portion of the side segment 112A is represented with phantom lines. The side segment 112A of the rear support 112 can be pivotally connected with a side surface 174 of the seat body 102 about the pivot axis X2. An end portion of the side segment 112A adjacent to the pivotal connection of the pivot axis X2 can have an inner cavity 176. The side surface 174 of the seat body 102 can include a raised portion 178 radially offset from the pivot axis X2. The raised portion 178 can have a ramped surface 180 that rises from the side surface 174, and can be at least partially received in the inner cavity 176. The outer surface 172 of the side segment 112A is formed with an opening 182 connecting with the inner cavity 176, and the impeding portion 170 can be guided through the opening 182 for sliding movement along the pivot axis X2 and transversally relative to the child seat 100. The impeding portion 170 is arranged such that it can be in sliding contact with the ramped surface 180. A spring 184 can be respectively connected with the impeding portion 170 and an inner sidewall of the side segment 112A. For facilitating the assembly of the spring 184, the side segment 112A can exemplary be affixed with an inner post 185 (shown with phantom lines), and the spring 184 can wrap around the inner post 185. The spring 184 can bias the impeding portion 170 to slide in a direction for retracting toward the interior of the side segment 112A.

The side segment 112A can further have a radial rib 186 arranged inside the inner cavity 176, and the side surface 174 of the seat body 102 can further have a stop rib 188 angularly spaced apart from the raised portion 178. The radial rib 186 can rotate away from the stop rib 188 when the rear support 112 is adjusted forward, and come into abutment against the stop rib 188 to define the rearward position of the rear support 112.

With the aforementioned construction, the impeding portion 170 can move in unison with the rear support 112, and also concurrently slide relative to the rear support 112 along the pivot axis X2 owing to the sliding contact with the ramped surface 178. More specifically, a rotation of the rear support 112 toward the rear of the child seat 100 results in the impeding portion 170 riding on the ramped surface 178, which causes the impeding portion 170 to move transversally relative to the rear support 112 and protrude outward from the outer surface 172 of the side segment 112A into the gap 122 defined between the connector 120 and the side segment 112A. On the other hand, a rotation of the rear support 112 toward the front of the child seat 100 to the forward position shown in FIGS. 5 and 6 results in the spring 184 biasing the impeding portion 170 to retract toward the interior of the side segment 112A and leave the gap 122.

Figure 12:
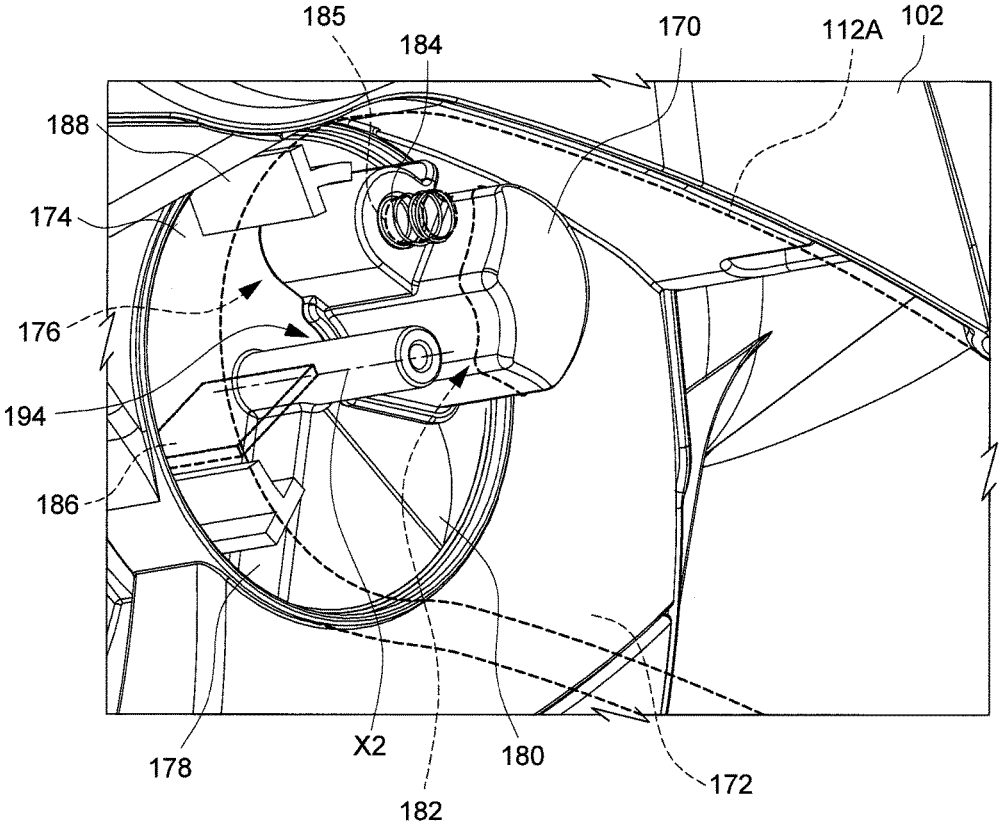
FIG. 12 is a schematic view illustrating the assembly of an impeding portion with a rear support in the child seat.

When the child seat 100 is converted to the mount configuration, the impeding portion 170 is therefore retracted toward the interior of the side segment 112A (as shown in FIG. 12) and substantially leaves the gap 122. As a result, the inner sidewall 216 of the socket 212 can travel into the gap 122 when each connector 120 is inserted into the socket 212 for installing the child seat 100 on the support frame 202.

Figure 13:
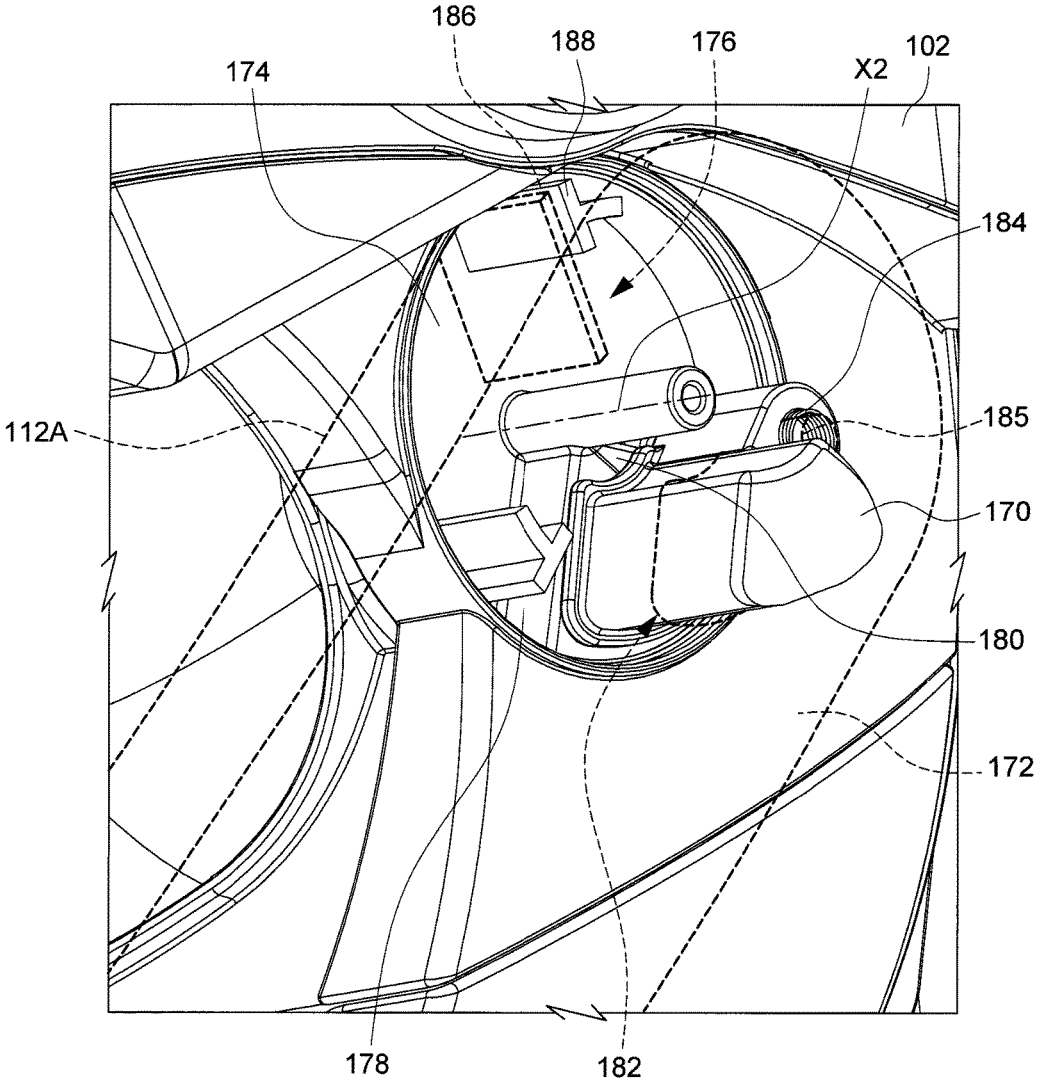
FIG. 13 is a schematic view illustrating a displacement of the impeding portion relative to the rear support.

In contrast, when the child seat 100 is in the booster seat configuration, the impeding portion 170 substantially protrudes outward from the opening 182 of the rear support 122 (as shown in FIG. 13) toward the connector 120. Accordingly, the impeding portion 170 is in an obstructing position in the gap 122 (as better shown in FIG. 2), and can block travel of the inner sidewall 216 of the socket 212 into the gap 122. As a result, the connector 120 cannot properly insert in the socket 212 when the child seat 100 is in the booster seat configuration. This can prevent erroneous installation while the child seat 100 is in the booster seat configuration.

Figure 14:
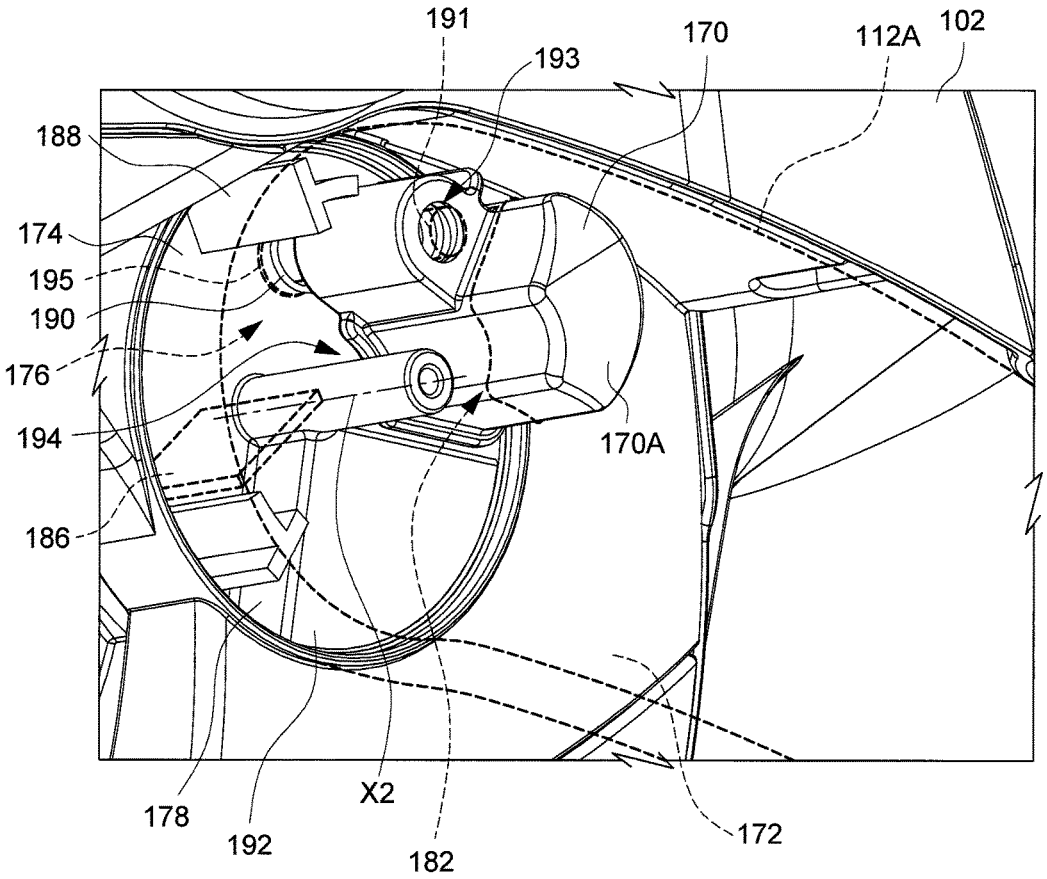
FIG. 14 is schematic view illustrating a variant embodiment of the aforementioned safety mechanism using the impeding portion.
Figure 15:
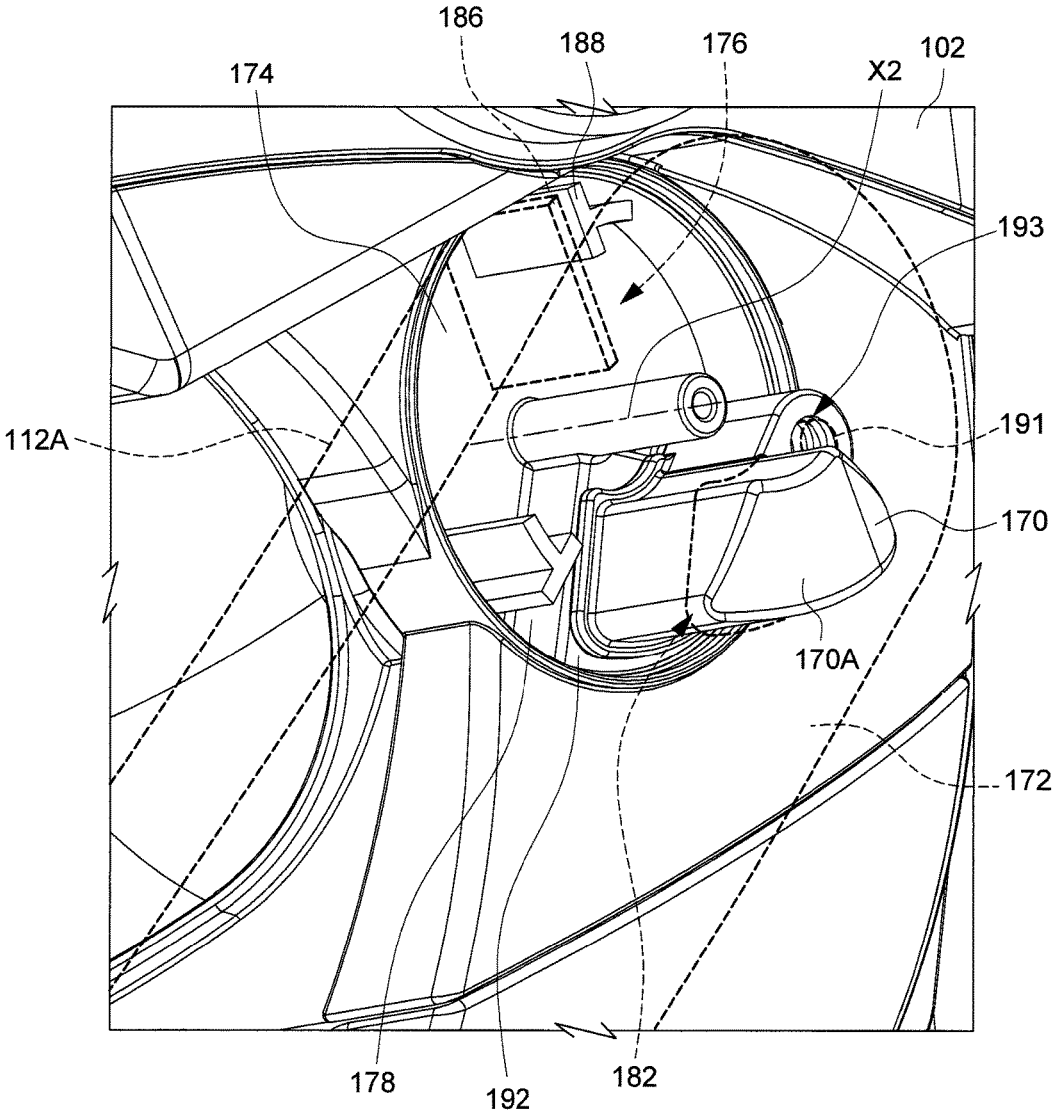
FIG. 15 is a schematic view illustrating a displacement of the impeding portion along with the rear support adjusted to the booster seat configuration.

FIGS. 14-17 are schematic views illustrating a variant embodiment of the aforementioned safety mechanism using the impeding portion 170. In the embodiment of FIGS. 14-17, the impeding portion 170 is urged to protrude outward the opening 182 by a spring 190, which substitutes for the spring 184 previously described. The side segment 112A can be affixed with an inner post 191 having a distal end provided with a stop flange 195 (shown with phantom lines). The stop flange 195 can be, for example, a screw engaged through the inner post 191. The inner post 191 can be guided through a hole 193 formed in the impeding portion 170, and the spring 190 can be assembled around the inner post 191. The spring 190 can have two ends respectively connected with the impeding portion 170 and the stop flange 195. The spring 190 thereby assembled can bias the impeding portion 170 for projecting outward the opening 182. Moreover, an outer end portion of the impeding portion 170 can form a ramped surface 170A, and the raised portion 178 can have a blocking surface 192. In this embodiment, the raised portion 178 has no ramped surface 180 as previously described. A rotation of the rear support 112 toward the front of the child seat 100 to the forward position shown in FIGS. 5 and 6 drives displacement of the impeding portion 170 in a plane perpendicular to the pivot axis X2 away from the blocking surface 192 (as shown in FIG. 14), and a rotation of the rear support 112 toward the rear of the child seat 100 drives displacement of the impeding portion 170 in the plane perpendicular to the pivot axis X2 toward a position abutting the blocking surface 192 (as shown in FIG. 15).

Figure 16:
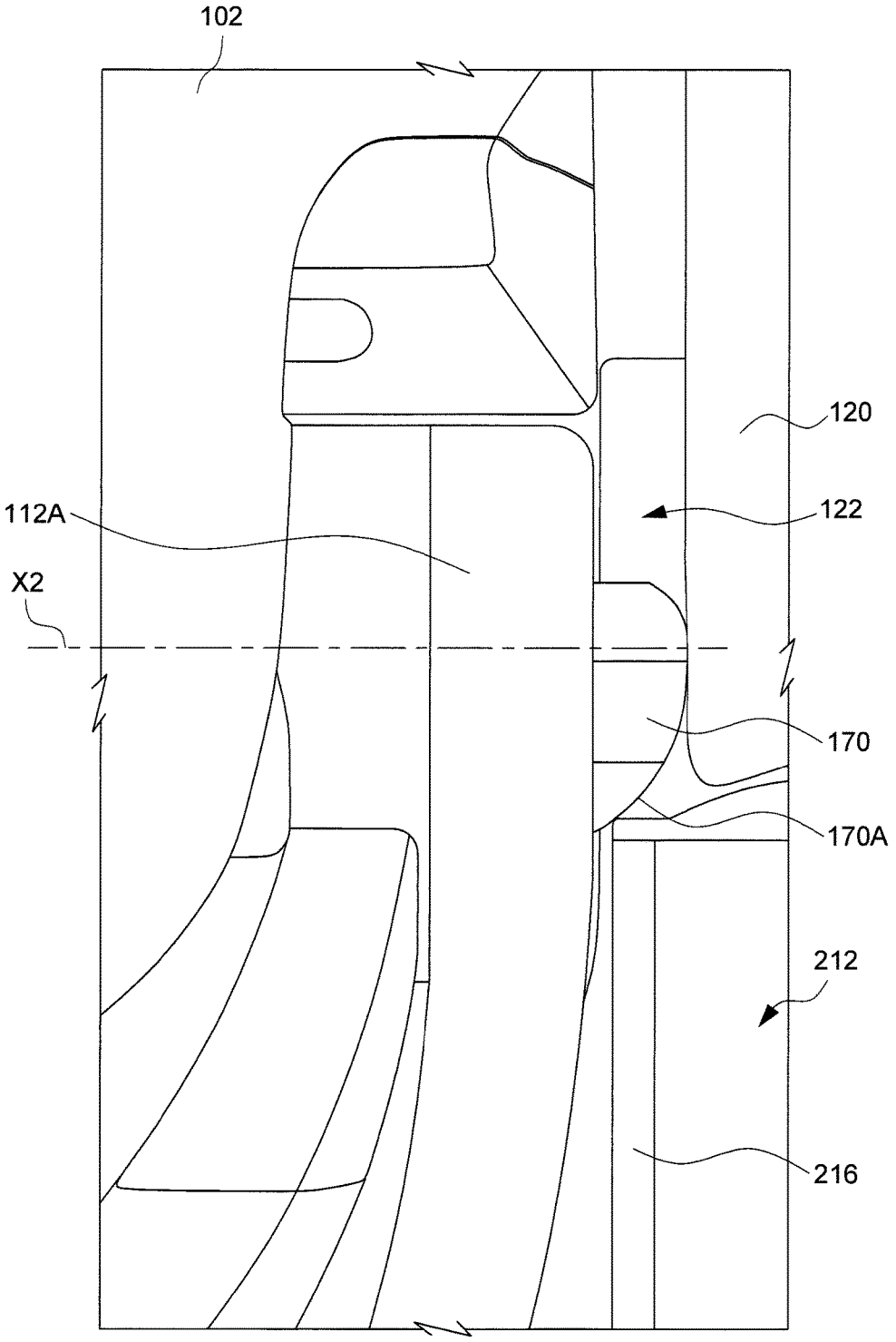
FIGS. 16 and 17 are schematic views illustrating the insertion of a connector of the child seat into a socket of a support frame while the child seat having the impeding portion as shown in FIG. 14 is in the mount configuration.
Figure 17:
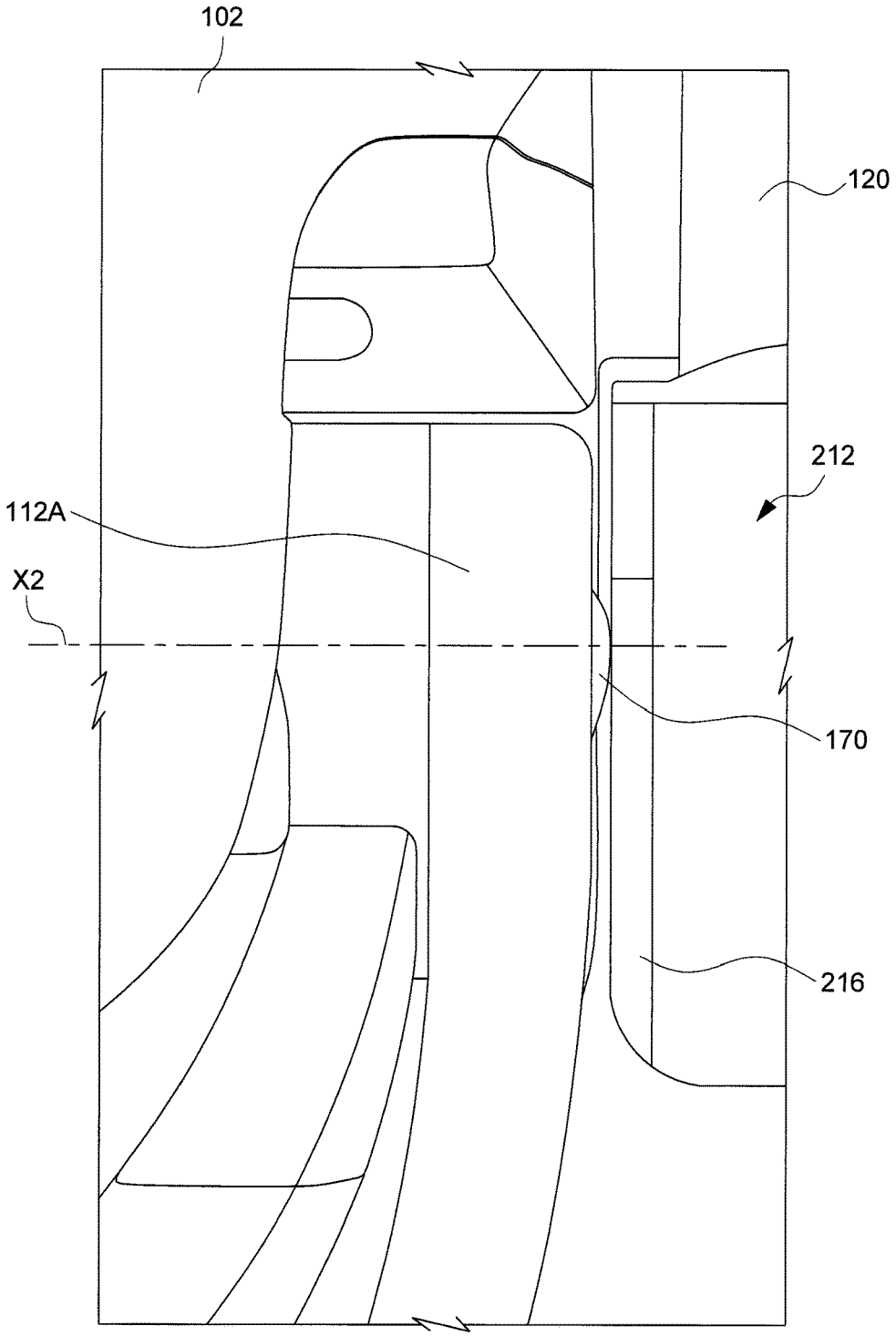

Referring to FIG. 14, when the child seat 100 is converted to the mount configuration, the impeding portion 170 is angularly displaced away from the raised portion 178 so that the blocking surface 192 does not abut with the impeding portion 170. Moreover, the impeding portion 170 is urged by the spring 190 and protrudes outward into the gap 122 between the side segment 112A of the rear support 112 and the connector 120, and a clearance 194 is left between the side surface 174 of the seat body 102 and the impeding portion 170. In conjunction with FIG. 14, FIGS. 16 and 17 are schematic views illustrating an insertion of the connector 120 into the socket 212 while the child seat 100 is in the mount configuration. While the connector 120 slides into the socket 212, the inner sidewall 216 can contact with the ramped surface 170A of the impeding portion 170, which pushes the impeding portion 170 to retract toward the inner cavity 176 of the side segment 112A and compress the spring 190. The impeding portion 170 can thereby substantially leave the gap 122, and the inner sidewall 216 of the socket 212 can continue to travel into the gap 122 until the connector 120 is properly inserted and locked in the socket 212.

Referring to FIG. 15, when the child seat 100 is in the booster seat configuration, the impeding portion 170 is angularly displaced toward the raised portion 178 so that the blocking surface 192 abuts the impeding portion 170. Moreover, the impeding portion 170 is biased by the spring 190 and protrudes outward from the opening 182 of the rear support 122 toward the connector 120. Owing to the abutment of the blocking surface 192, the impeding portion 170 cannot retract toward the inner cavity 176 of the side segment 112A. The impeding portion 170 is thereby kept in an obstructing position in the gap 122, and can block travel of the inner sidewall 216 of the socket 212 into the gap 122. As a result, the connector 120 cannot properly inserted in the socket 212 when the child seat 100 is in the booster seat configuration.

Figure 18:
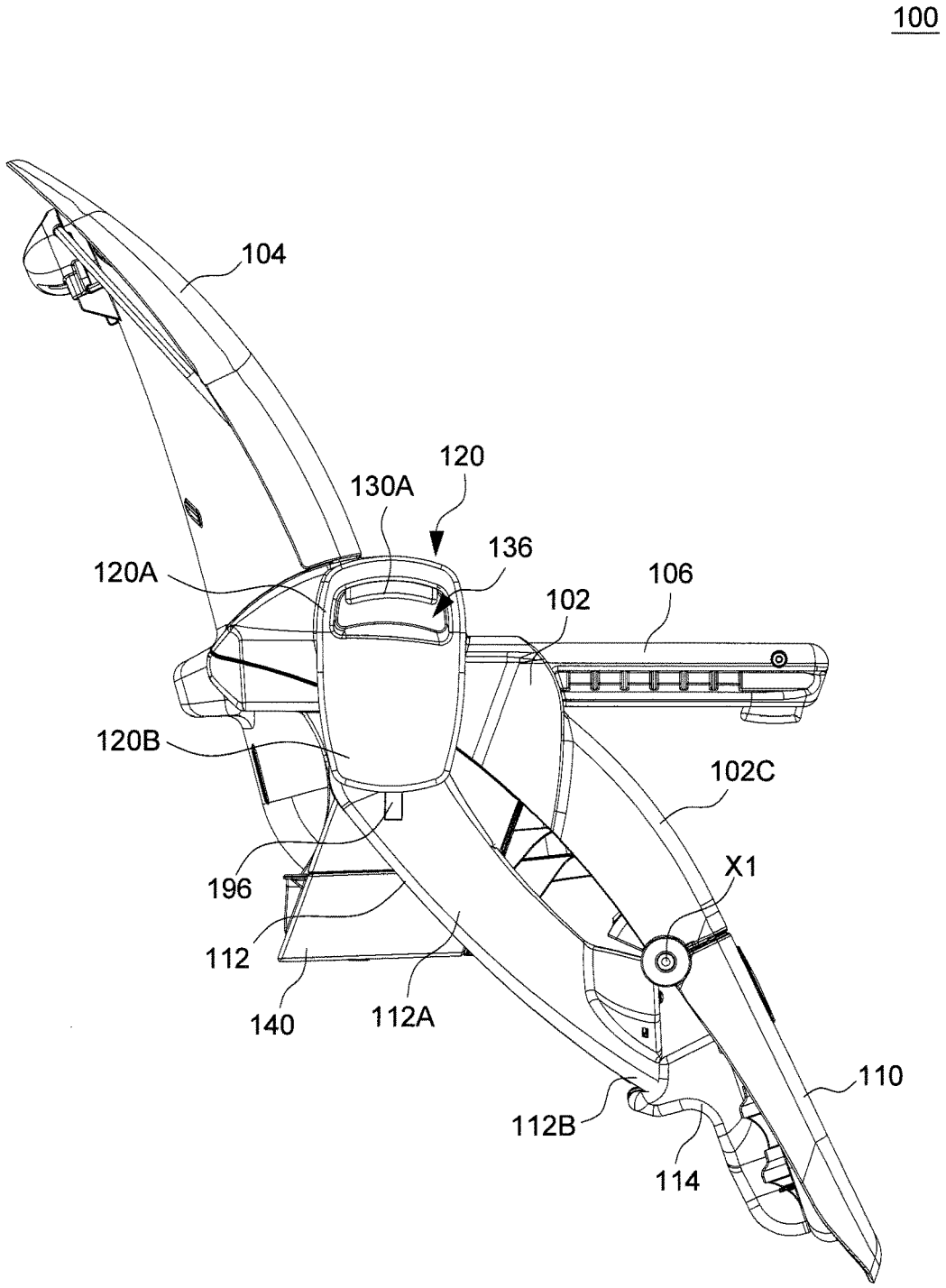
FIG. 18 is a schematic view illustrating another embodiment of a child seat having an impeding portion affixed with the rear support.
Figure 19:
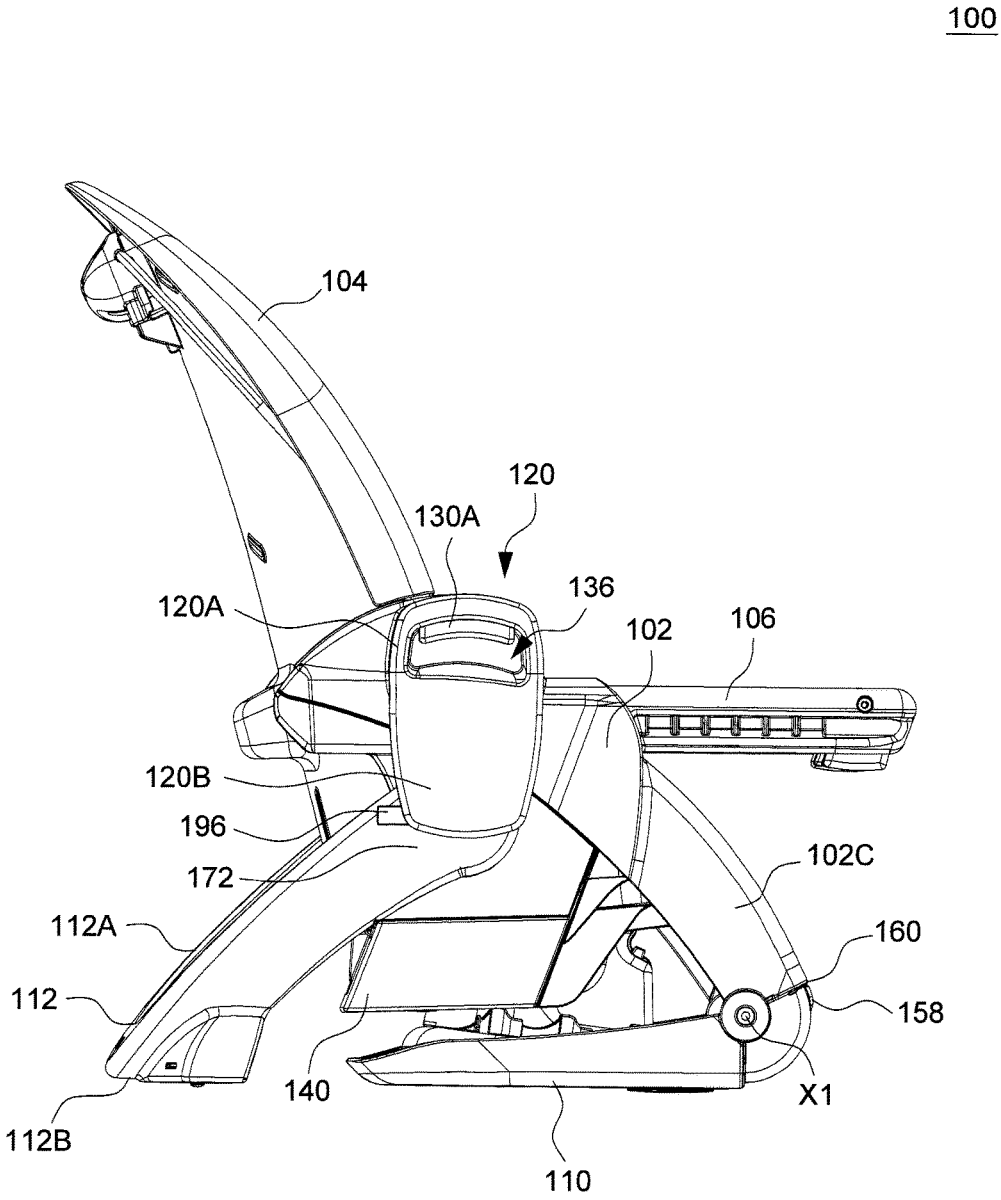
FIG. 19 is a schematic view illustrating a displacement of the impeding portion shown in FIG. 18 as the rear support is positioned rearward.
Figure 20:
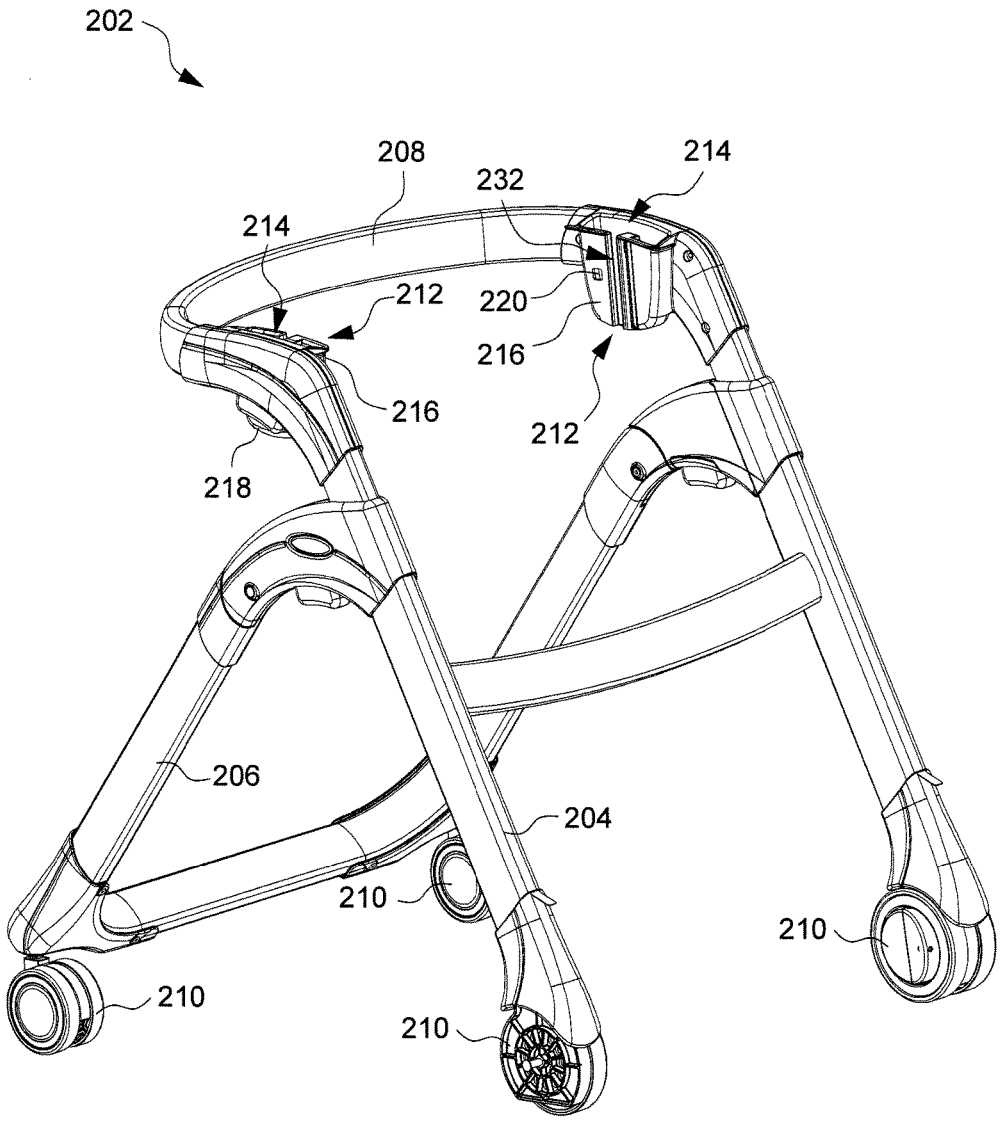
FIG. 20 is a schematic view illustrating a support frame adapted to receive the installation of the child seat shown in FIG. 19.

FIGS. 18-20 are schematic views illustrating another embodiment of a safety mechanism for preventing improper installation of the child seat 100 on the support frame 202 while the child seat 100 is in the booster seat configuration. In this embodiment, the safety mechanism likewise includes one or more impeding portion 196. Each impeding portion 196 can be respectively affixed with one corresponding side segment 112A of the rear support 112 near the pivot axis X2, and can project transversally outward from the outer surface 172 of the side segment 112A toward the gap 122. The impeding portion 196 is thus movable in unison with the second support 112 about the pivot axis X2. Moreover, referring to FIG. 20, the inner sidewall 216 of the socket 212 on the support frame 202 can have an elongated channel 232. The elongated channel 232 can extend vertically, and can allow passage of the impeding portion 196 when the connector 120 is inserted into the socket 212.

Referring to FIG. 18, while the rear support 112 is positioned forward in the mount configuration, the connectors 120 can be respectively inserted into the sockets 212 for installation on the support frame 202. The forward position of the rear support 112 allows the impeding portion 196 to be aligned with the elongated channel 232. Accordingly, the impeding portion 196 can match and travel along the elongated channel 232 during insertion of the connectors 120 into the sockets 212, and the child seat 100 can be properly attached with the support frame 202.

Referring to FIG. 19, a rearward position of the rear support 112 displaces the impeding portion 196 to an obstructing position. If a caregiver attempts to install the child seat 100 on the support frame 202 while the rear support 112 is positioned rearward in the booster seat configuration, the impeding portion 196 is misaligned and cannot match with the elongated channel 232. As a result, the impeding portion 196 can block insertion of the connectors 120 into the sockets 212, and the child seat 100 cannot be installed on the support frame 202.

Advantages of the structures described herein include the ability to convert the child seat to multiple configurations of use. The child seat has a front and a rear support that can be adjusted to convert the child between a mount configuration in which it can be installed on a support frame (e.g., the support frame of a high chair), and a booster seat configuration in which it can stand on a support surface in a stable manner independent of the support frame. Therefore, the child seat 100 can offer a more flexible use adapted to the caregiver's needs. In addition, safety mechanisms may be prevent improper installation of the child seat on the support frame while it is in the booster seat configuration.

Realizations of the child seat have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A child seat comprising:

a seat body having a seating surface, a bottom surface below the seating surface, a front portion for placement of a child's legs; and a first and a second support respectively assembled with the seat body about a first and a second pivot axis spaced apart from each other and extending transversally relative to the seat body, the first and second support being extendable below the bottom surface; and a connector supported on the seat body and laterally overlapping the second support;

wherein the child seat has a first configuration in which the first support is configured as a leg resting board and the second support extends forward toward the first support, and a second configuration in which the first support is folded to a substantially horizontal position and the second support extends rearward so that the child seat is able to stand on the first and second supports; and wherein the second support has an impeding portion movably supported on the second support, the impeding portion is moved by camming action to open a gap between the connector and the second support in the first configuration, and the impeding portion is moved and held to close the gap between the connector and the second support in the second configuration.

2. The child seat according to claim 1, wherein the second pivot axis is above and rearward from the first pivot axis.

3. The child seat according to claim 1, wherein the second support is locked with the first support in the first configuration, and the second support is unlocked from the first support in the second configuration.

4. The child seat according to claim 3, wherein the second support has a portion that engages with the first support to lock the first and second supports together in the first configuration.

5. The child seat according to claim 3, wherein the second support has a portion that engages with the first support by interference fit to lock the first and second supports together in the first configuration.

6. The child seat according to claim 1, wherein the first support is folded toward the bottom surface in the second configuration.

7. The child seat according to claim 1, wherein the seat body includes a storage drawer near the bottom surface, when the child seat is in the second configuration the storage drawer being transversally opened relative to the seat body.

8. The child seat according to claim 7, wherein the storage drawer is opened and blocks a rotation of the second support toward the front portion when the child seat is in the second configuration.

9. The child seat according to claim 8, wherein the second support blocks opening of the storage drawer when the child seat is in the first configuration.

10. The child seat according to claim 7, wherein the seat body has an opening for receiving the storage drawer, the opening has a rim, the storage drawer has an edge in which is formed a slit, and the rim engages through the slit when the storage drawer is fully closed.

11. The child seat according to claim 1, wherein the second support straddles the bottom surface.

12. The child seat according to claim 1, wherein the connector is insertable into a socket of a support frame for attaching the child seat with the support frame when the child seat is in the first configuration, and the impeding portion is displaced to an obstructing position that hinders a proper insertion of the connector into the socket when the impeding portion is moved to close the gap when the child seat is in the second configuration.

13. The child seat according to claim 1, wherein the impeding portion is affixed with the second support and is rotatable with the second support about the second pivot axis.

14. The child seat according to claim 1, wherein the impeding portion is assembled with the second support for sliding displacement along the second pivot axis.

15. The child seat according to claim 14, wherein a rearward rotation of the second support occurring when the child seat is converted from the first configuration to the second configuration causes the impeding portion to slide relative to the second support to project outward from the second support.

16. The child seat according to claim 14, wherein the impeding portion is connected with a spring, the spring driving the impeding portion to displace inward relative to the second support when the second support rotates forward for converting the child seat from the second configuration to the first configuration.

17. The child seat according to claim 14, wherein a rearward rotation of the second support occurring when the child seat is converted from the first configuration to the second configuration causes the impeding portion to come in abutment with a blocking surface, the blocking surface preventing retraction of the impeding portion toward an interior of the second support such that the impeding portion is restrained to remain in a position projecting outward from the second support and toward the connector.

18. The child seat according to claim 1, wherein the first and second supports are coupled with each other via a linking part comprised of a strap.

19. A child seat comprising:

a seat body having a seating surface, a bottom surface below the seating surface, and a front portion for placement of a child's legs;

a first and a second support respectively assembled with the seat body via a first and a second pivotal connection, the first and second support being extendable below the bottom surface; and a connector supported on the seat body and laterally overlapping the second support;

wherein the first and second supports are respectively rotatable relative to the seat body to convert the child seat between a first and a second configuration, the first and second supports respectively extending forward from the first and second pivotal connections in the first configuration, and the first support being folded to a substantially horizontal position and the second support extending rearward so that the child seat is able to stand on the first and second supports in the second configuration; and wherein the second support has an impeding portion movably supported on the second support, the impeding portion is moved by camming action to open a gap between the connector and the second support in the first configuration, and the impeding portion is moved and held to close the gap between the connector and the second support in the second configuration.

20. The child seat according to claim 19, wherein the second pivotal connection is above and rearward from the first pivotal connection.

* * * * *